US012529183B2

(12) United States Patent
Dunn et al.

(10) Patent No.: US 12,529,183 B2
(45) Date of Patent: Jan. 20, 2026

(54) CABINET ASSEMBLY FOR A COMBINATION LAUNDRY APPLIANCE

(71) Applicant: Haier US Appliance Solutions, Inc., Wilmington, DE (US)

(72) Inventors: David Scott Dunn, Louisville, KY (US); Jivko Ognianov Djerekarov, Louisville, KY (US); Wayne E. Lawson, La Grange, KY (US); Sarah Heiniger, Louisville, KY (US); David G. Beers, New Albany, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 239 days.

(21) Appl. No.: 18/366,311

(22) Filed: Aug. 7, 2023

(65) Prior Publication Data

US 2025/0051994 A1 Feb. 13, 2025

(51) Int. Cl.

| | |
|---|---|
| ***D06F 39/12*** | (2006.01) |
| ***D06F 25/00*** | (2006.01) |
| ***D06F 37/22*** | (2006.01) |
| ***D06F 39/08*** | (2006.01) |
| ***D06F 58/20*** | (2006.01) |
| ***D06F 58/24*** | (2006.01) |

(52) U.S. Cl.
CPC ..... *D06F 39/12* (2013.01); *D06F 25/00* (2013.01); *D06F 37/22* (2013.01); *D06F 39/088* (2013.01); *D06F 58/206* (2013.01); *D06F 58/24* (2013.01)

(58) Field of Classification Search
None
See application file for complete search history.

(56) References Cited

U.S. PATENT DOCUMENTS 10,275,978 B2 * 4/2019 Yang ..... D06F 34/34

FOREIGN PATENT DOCUMENTS

| | | |
|---|---|---|
| EP | 2781644 A1 | 9/2014 |
| JP | 4387867 B2 | 12/2009 |
| JP | 2019000256 A | 1/2019 |

* cited by examiner

*Primary Examiner* — Rita P Adhlakha
(74) *Attorney, Agent, or Firm* — Dority & Manning, P.A.

(57) ABSTRACT

A laundry appliance includes an apron extending between a bottom end and a top end along the vertical direction, an apron extension positioned on the top end of the apron and defining a mechanical compartment, wherein a rear wall of the apron extension extends past a rear wall of the apron along the transverse direction to define an overhang space under the apron extension, and a conditioning system positioned within the mechanical compartment and configured to heat and remove moisture from air flowing therethrough, the conditioning system comprising a compressor, an evaporator, and a condenser.

17 Claims, 13 Drawing Sheets

CABINET ASSEMBLY FOR A COMBINATION LAUNDRY APPLIANCE

FIELD OF THE INVENTION

The present subject matter relates generally to combination washer/dryer laundry appliances, or more specifically, to a cabinet assembly for a combination laundry appliance and a method of assembling the same.

BACKGROUND OF THE INVENTION

Laundry appliances are commonly sold in appliance pairs, e.g., a washing machine appliance for washing clothes and a dryer appliance for drying clothes. By contrast, certain conventional laundry appliances are combination washer/dryer units that wash and dry clothes in the same drum. Accordingly, during a washing cycle of a combination laundry appliance, wash fluid is added to the drum, the load of clothes is agitated during an agitation cycle, a rinse cycle is performed, and a spin cycle is used to extract excess water from the load of clothes while a drain pump evacuates the wash fluid in the drum. After the washing operation is complete, the combination laundry may switch to a drying cycle, where the clothes are tumbled as warm, dry air is circulated within the drum.

In order to facilitate a drying cycle of the combination laundry appliance, a motor rotates the drum, e.g., to tumble articles located within a chamber defined by the drum. In addition, combination laundry appliances generally include a system for passing dry, heated air through the chamber in order to dry moisture-laden articles positioned therein. In this regard, the appliance includes a sealed system or a conditioning system for extracting moisture from the process air before reheating it and returning it to the drum. The conditioning system may include a compressor, a condenser, and an evaporator. Typically, an air handler or blower is used to urge the flow of heated air through the chamber to dry the clothes.

Notably, conventional combination washer/dryers have very limited internal space for storing sealed system components, resulting in small sealed system components and drying capacity. As a result, drying efficiency is very poor, resulting in very long dry times and user dissatisfaction. However, making a larger appliance including a larger cabinet is often prohibitively expensive, e.g., due to costs associated with the entire system redesign and necessary retooling. Furthermore, increasing the space within conventional combination washers/dryers may include the addition of components that reduce the rigidity of the cabinet or result in complex assembly and increased costs.

Accordingly, a combination washer/dryer appliance with features for facilitating faster cycle times would be desirable. More specifically, a combination laundry appliance that houses a larger sealed system with improved structural rigidity and reduced costs would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a laundry appliance defining a vertical direction, a lateral direction, and a transverse direction is provided. The laundry appliance includes an apron extending between a bottom end and a top end along the vertical direction, a tub positioned within the apron, a wash basket rotatably mounted within the tub, the wash basket defining a chamber for receipt of articles for washing and drying, an apron extension positioned on the top end of the apron and defining a mechanical compartment, wherein a rear wall of the apron extension extends past a rear wall of the apron along the transverse direction to define an overhang space under the apron extension, and a conditioning system positioned within the mechanical compartment and configured to heat and remove moisture from air flowing therethrough, the conditioning system comprising a compressor, an evaporator, and a condenser.

In another exemplary embodiment, a laundry appliance defining a vertical direction, a lateral direction, and a transverse direction is provided. The laundry appliance includes an apron extending between a bottom end and a top end along the vertical direction, the apron defining a plurality of mounting studs extending from the top end of the apron and an apron extension positioned on the top end of the apron and defining a plurality of keyhole slots configured for engaging the plurality of mounting studs to attach the apron extension to the apron, wherein a rear wall of the apron extension extends past a rear wall of the apron along the transverse direction to define an overhang space under the apron extension.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
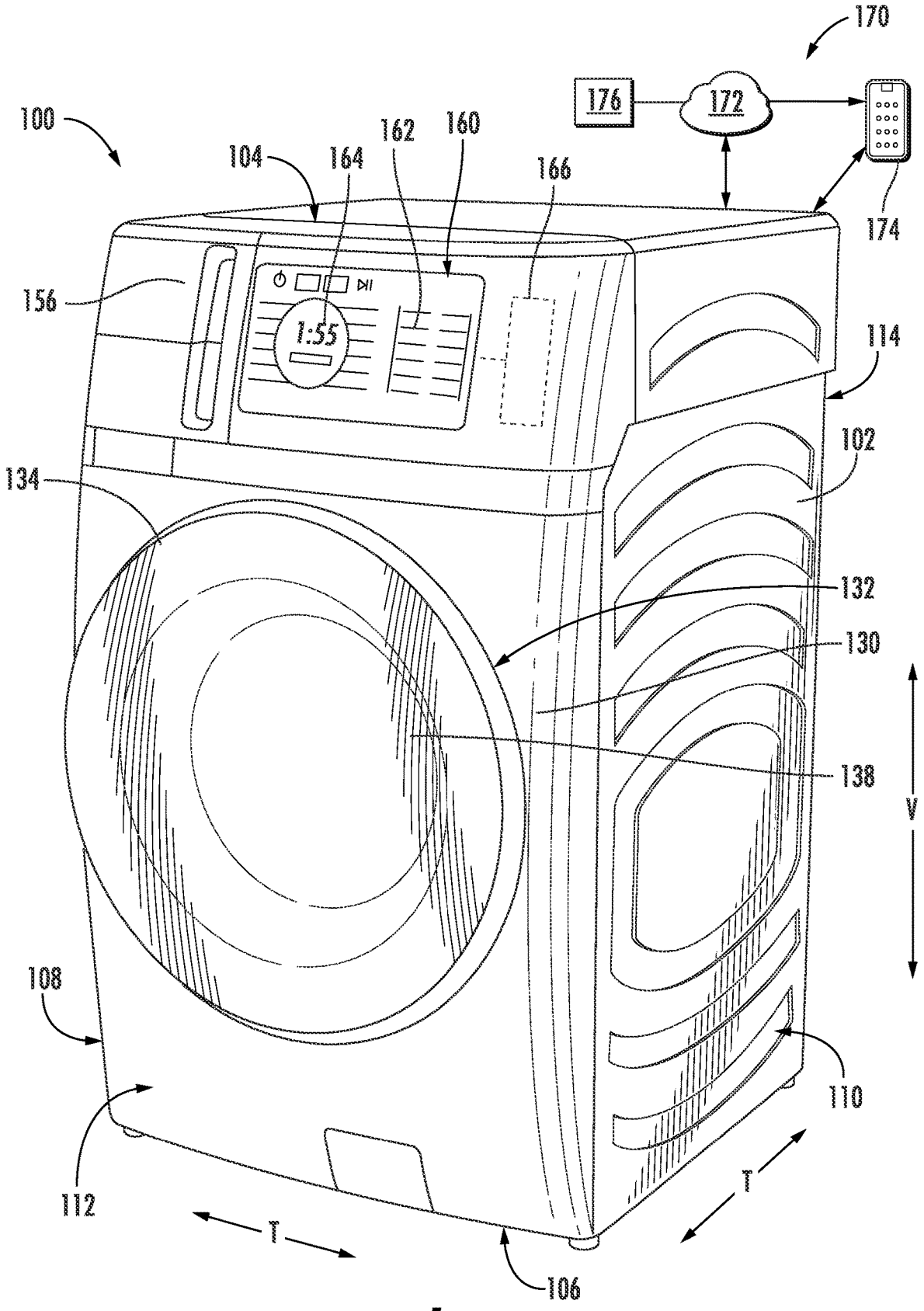
FIG. 1 provides a perspective view of a combination washer/dryer laundry appliance in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
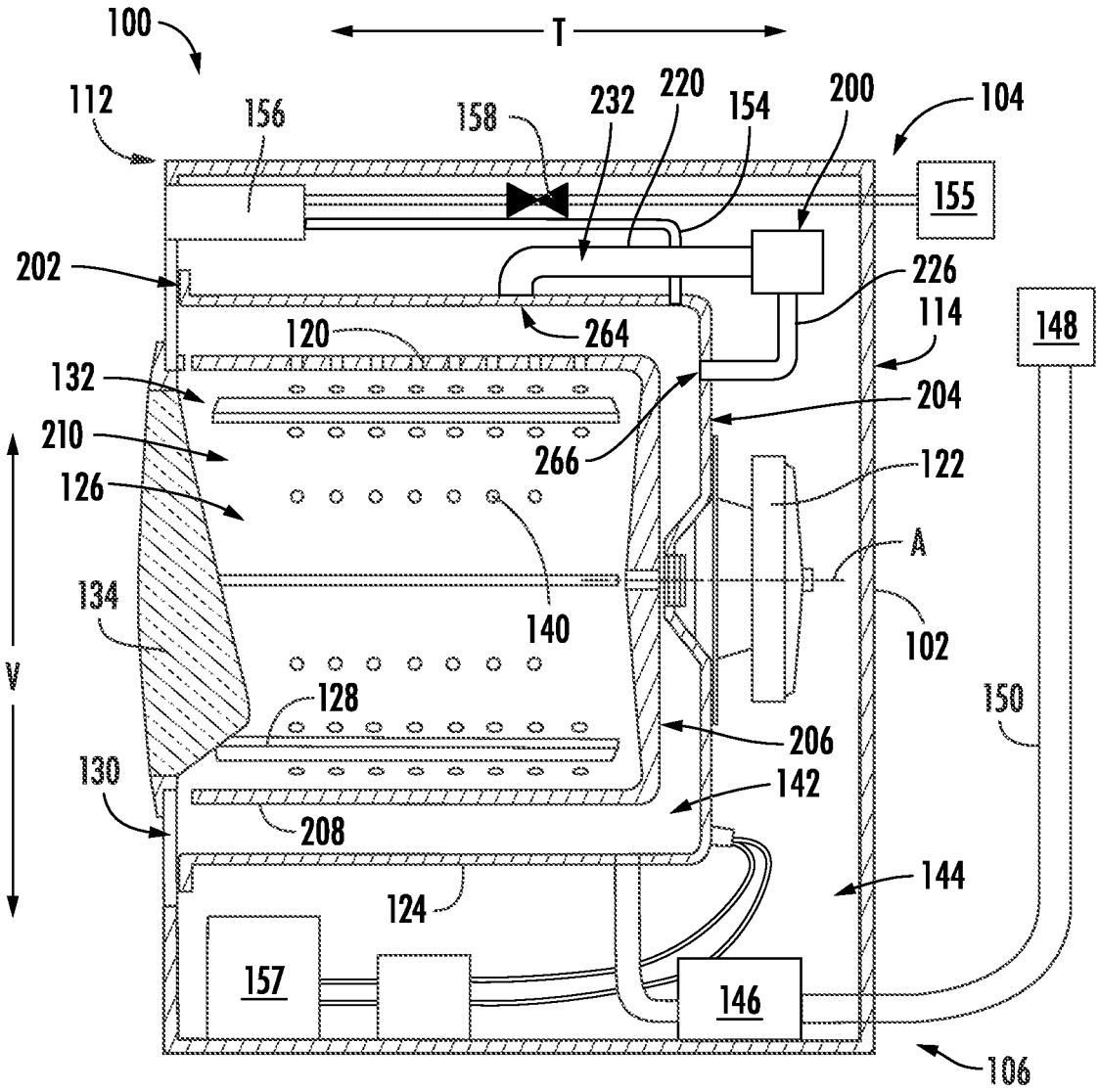
FIG. 2 provides a side cross-sectional view of the exemplary laundry appliance of FIG. 1.
Figure 4:
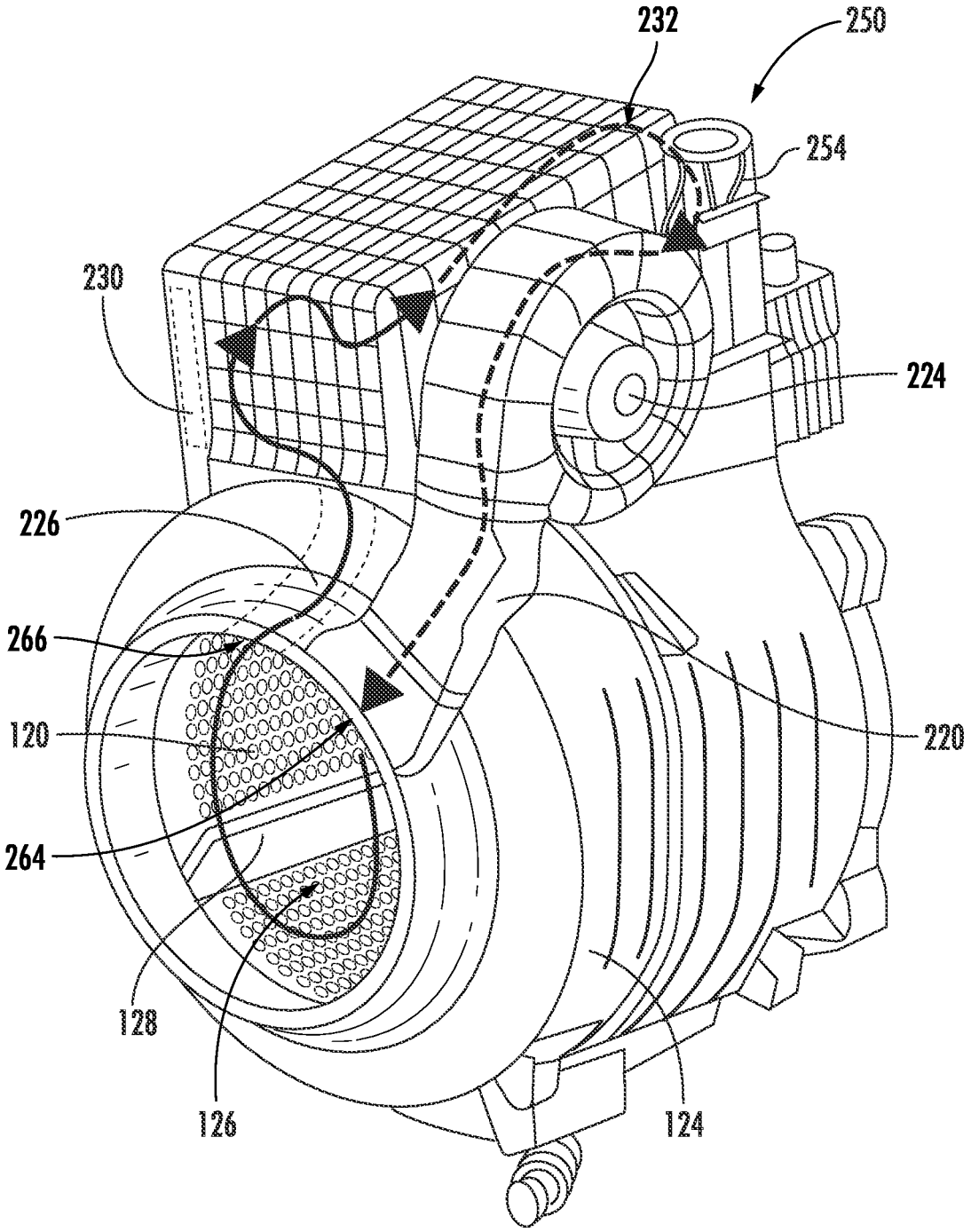
FIG. 4 provides a perspective view of the example laundry appliance of FIG. 1 with a cabinet assembly of the laundry appliance removed to reveal certain components of the dryer appliance.

Referring now to the figures, an exemplary laundry appliance that may be used to implement aspects of the present subject matter will be described. Specifically, FIG. 1 is a perspective view of an exemplary horizontal axis washer and condenser dryer combination appliance 100, referred to herein for simplicity as laundry appliance 100. FIG. 2 is a side cross-sectional view of laundry appliance 100. FIG. 4 is a perspective view of laundry appliance 100 with cabinet assembly 102 removed. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet assembly 102 that extends between a top 104 and a bottom 106 along the vertical direction V, between a left side 108 and a right side 110 along the lateral direction, and between a front 112 and a rear 114 along the transverse direction T.

Referring to FIG. 2, a laundry basket 120 is rotatably mounted within cabinet assembly 102 such that it is rotatable about an axis of rotation A. According to the illustrated embodiment, axis of rotation A is substantially parallel to or slightly inclined relative to the horizontal direction (e.g., the transverse direction T), as this exemplary appliance is a front load appliance. A motor 122, e.g., such as a pancake motor, is in mechanical communication with laundry basket 120 to selectively rotate laundry basket 120 (e.g., during an agitation or a rinse cycle of laundry appliance 100). Motor 122 may be mechanically coupled to laundry basket 120 directly or indirectly, e.g., via a pulley and a belt (not pictured). Laundry basket 120 is received within a tub 124 that defines a chamber 126 that is configured for receipt of articles for washing or drying.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together and/or dried together in laundry appliance 100 (e.g., the combination washer and condenser dryer) and may include a mixture of different or similar articles of clothing of different or similar types and kinds of fabrics, textiles, garments and linens within a particular laundering process.

The tub 124 holds wash and rinse fluids for agitation in laundry basket 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Laundry basket 120 may define one or more agitator features that extend into chamber 126 to assist in agitation, cleaning, and drying of articles disposed within chamber 126 during operation of laundry appliance 100. For example, as illustrated in FIG. 2, a plurality of baffles or ribs 128 extend from basket 120 into chamber 126. In this manner, for example, ribs 128 may lift articles disposed in laundry basket 120 and then allow such articles to tumble back to a bottom of drum laundry basket 120 as it rotates. Ribs 128 may be mounted to laundry basket 120 such that ribs 128 rotate with laundry basket 120 during operation of laundry appliance 100.

Referring generally to FIGS. 1 and 2, cabinet assembly 102 also includes a front panel 130 which defines an opening 132 that permits user access to laundry basket 120 and tub 124. More specifically, laundry appliance 100 includes a door assembly 134 that is positioned over opening 132 and is rotatably mounted to front panel 130. In this manner, door assembly 134 permits selective access to opening 132 by being movable between an open position (not shown) facilitating access to a tub 124 and a closed position (FIG. 1) prohibiting access to tub 124. Laundry appliance 100 may further include a latch assembly that is mounted to cabinet assembly 102 and/or door assembly 134 for selectively locking door assembly 134 in the closed position. The latch assembly may be desirable, for example, to ensure only secured access to chamber 126 or to otherwise ensure and verify that door assembly 134 is closed during certain operating cycles or events.

A window 138 in door assembly 134 permits viewing of laundry basket 120 when door assembly 134 is in the closed position, e.g., during operation of laundry appliance 100. Door assembly 134 also includes a handle (not shown) that, e.g., a user may pull when opening and closing door assembly 134. Further, although door assembly 134 is illustrated as mounted to front panel 130, it should be appreciated that door assembly 134 may be mounted to another side of cabinet assembly 102 or any other suitable support according to alternative embodiments.

Referring again to FIG. 2, laundry basket 120 also defines a plurality of perforations 140 in order to facilitate fluid communication between an interior of basket 120 and tub 124. A sump 142 is defined by tub 124 at a bottom of tub 124 along the vertical direction V. Thus, sump 142 is configured for receipt of and generally collects wash fluid during operation of laundry appliance 100. For example, during operation of laundry appliance 100, wash fluid may be urged by gravity from basket 120 to sump 142 through plurality of perforations 140.

A drain pump assembly 144 is located beneath tub 124 and is in fluid communication with sump 142 for periodically discharging soiled wash fluid from laundry appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into tub 124. For example, spout 154 may be in fluid communication with a water supply 155 (FIG. 2) in order to direct fluid (e.g., clean water or wash fluid) into tub 124. Spout 154 may also be in fluid communication with the sump 142. For example, pump assembly 144 may direct wash fluid disposed in sump 142 to spout 154 in order to circulate wash fluid in tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In optional embodiments, a bulk reservoir 157 is disposed within cabinet assembly 102 and is configured for receipt of fluid additive or detergent for use during operation of laundry appliance 100. Moreover, bulk reservoir 157 may be sized such that a volume of fluid additive sufficient for a plurality or multitude of wash cycles of laundry appliance 100 (e.g., five, ten, twenty, fifty, or any other suitable number of wash cycles) may fill bulk reservoir 157. Thus, for example, a user can fill bulk reservoir 157 with fluid additive and operate laundry appliance 100 for a plurality of wash cycles without refilling bulk reservoir 157 with fluid additive. A reservoir pump (not shown) may be configured for selective delivery of the fluid additive from bulk reservoir 157 to tub 124.

In addition, a water supply valve or control valve 158 may provide a flow of water from a water supply source (such as a municipal water supply 155) into detergent dispenser 156 and/or into tub 124. In this manner, control valve 158 may generally be operable to supply water into detergent dispenser 156 to generate a wash fluid, e.g., for use in a wash cycle, or a flow of fresh water, e.g., for a rinse cycle. It should be appreciated that control valve 158 may be positioned at any other suitable location within cabinet assembly 102. In addition, although control valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of laundry appliance 100 is controlled by a controller or processing device 166 (FIG. 1) that is operatively coupled to control panel 160 for user manipulation to select laundry cycles and features. In response to user manipulation of control panel 160, controller 166 operates the various components of laundry appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

During operation of laundry appliance 100, laundry items are loaded into laundry basket 120 through opening 132, and washing operation is initiated through operator manipulation of input selectors 162. Tub 124 is filled with water, detergent, and/or other fluid additives, e.g., via spout 154 and or detergent drawer 156. One or more valves (e.g., control valve 158) can be controlled by laundry appliance 100 to provide for filling laundry basket 120 to the appropriate level for the amount of articles being washed and/or rinsed. By way of example for a wash mode, once laundry basket 120 is properly filled with fluid, the contents of laundry basket 120 can be agitated (e.g., with ribs 128) for washing of laundry items in laundry basket 120.

After the agitation phase of the wash cycle is completed, tub 124 can be drained. Laundry articles can then be rinsed by again adding fluid to tub 124, depending on the particulars of the cleaning cycle selected by a user. Ribs 128 may again provide agitation within laundry basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in laundry basket 120 are cleaned, washed, and/or rinsed, the user can remove the articles from laundry basket 120, e.g., by opening door assembly 134 and reaching into laundry basket 120 through opening 132.

While described in the context of a specific embodiment of horizontal axis laundry appliance 100, using the teachings disclosed herein it will be understood that horizontal axis laundry appliance 100 is provided by way of example only. Other laundry appliances having different configurations, different appearances, and/or different features may also be utilized with the present subject matter as well, e.g., vertical axis laundry appliances. Indeed, it should be appreciated that aspects of the present subject matter may further apply to other laundry appliances.

Referring still to FIG. 1, a schematic diagram of an external communication system 170 will be described according to an exemplary embodiment of the present subject matter. In general, external communication system 170 is configured for permitting interaction, data transfer, and other communications with laundry appliance 100. For example, this communication may be used to provide and receive operating parameters, user instructions or notifications, performance characteristics, user preferences, or any other suitable information for improved performance of laundry appliance 100.

External communication system 170 permits controller 166 of laundry appliance 100 to communicate with external devices either directly or through a network 172. For example, a consumer may use a consumer device 174 to communicate directly with laundry appliance 100. For example, consumer devices 174 may be in direct or indirect communication with laundry appliance 100, e.g., directly through a local area network (LAN), Wi-Fi, Bluetooth, Zigbee, etc. or indirectly through network 172. In general, consumer device 174 may be any suitable device for providing and/or receiving communications or commands from a user. In this regard, consumer device 174 may include, for example, a personal phone, a tablet, a laptop computer, or another mobile device.

In addition, a remote server 176 may be in communication with laundry appliance 100 and/or consumer device 174 through network 172. In this regard, for example, remote server 176 may be a cloud-based server 176, and is thus located at a distant location, such as in a separate state, country, etc. In general, communication between the remote server 176 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 172 can be any type of communication network. For example, network 172 can include one or more of a wireless network, a wired network, a personal area network, a local area network, a wide area network, the internet, a cellular network, etc. According to an exemplary embodiment, consumer device 174 may communicate with a remote server 176 over network 172, such as the internet, to provide user inputs, receive user notifications or instructions, etc. In addition, consumer device 174 and remote server 176 may communicate with laundry appliance 100 to communicate similar information.

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 3:
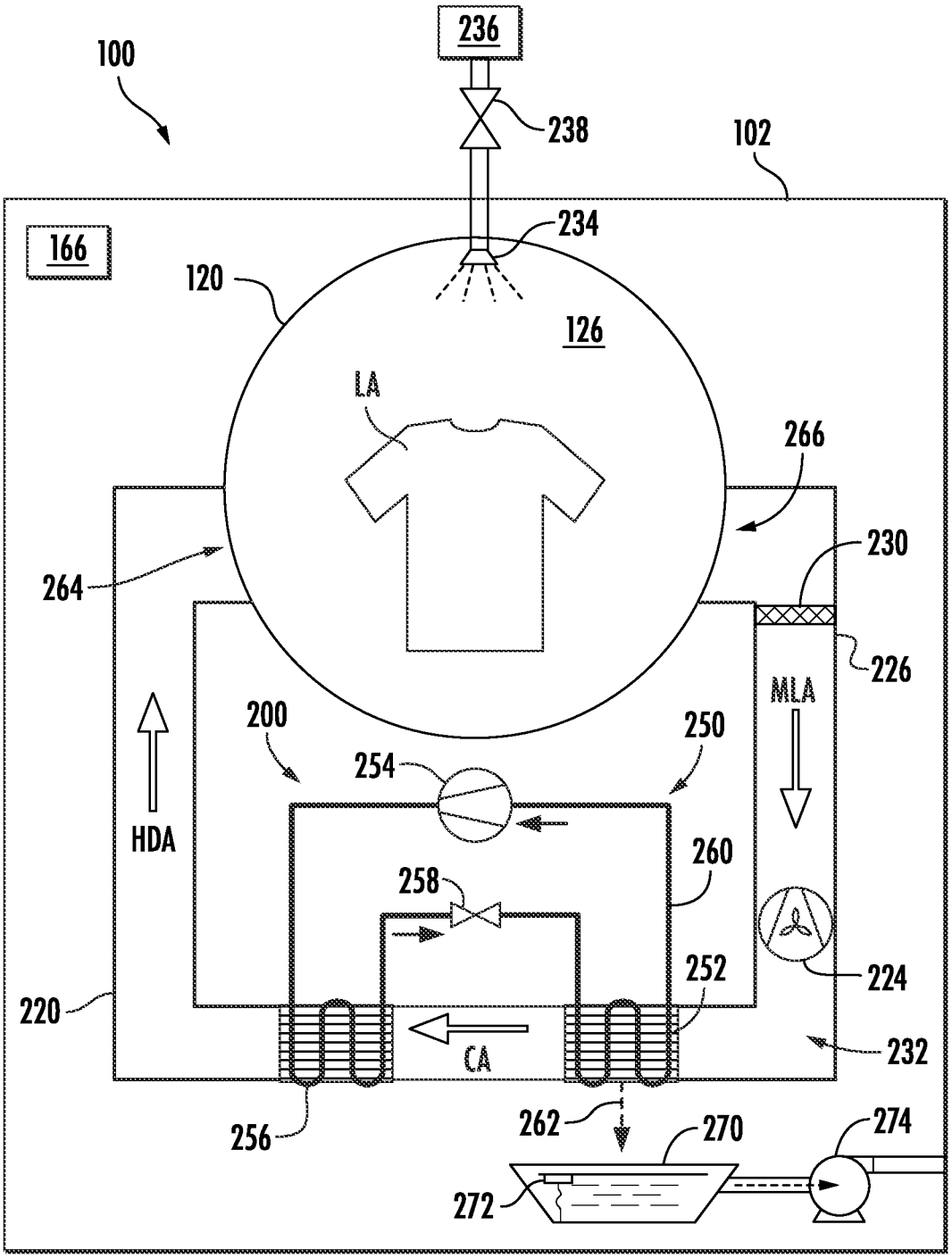
FIG. 3 provides a schematic diagram of an exemplary heat pump dryer appliance and a conditioning system thereof in accordance with exemplary embodiments of the present disclosure.

Referring now specifically to FIGS. 2 through 4, a heat pump system, a condenser system, a refrigerant-based air conditioning system, or another suitable conditioning system 200 for facilitating a drying process within laundry appliance 100 will be described in more detail. As illustrated, conditioning system 200 may be mounted to tub 124 such that it is fluidly coupled to chamber 126. More specifically, as illustrated, tub 124 extends between a front portion 202 and a back portion 204, e.g., along the transverse direction T. Laundry basket 120 also includes a back or rear wall 206, e.g., at back portion of laundry basket 120 or proximate back portion 204 of tub 124. Rear wall 206 of laundry basket 120 may be rotatably supported within cabinet assembly 102 by a suitable bearing and/or may be fixed or rotatable.

Laundry basket 120 is generally cylindrical in shape. Laundry basket 120 has an outer cylindrical wall 208 and a front flange or wall that defines an opening 210 of laundry basket 120, e.g., at front portion 202 of laundry basket 120. As shown, opening 210 generally coincides with opening 132 of front panel 112 of cabinet assembly 102, e.g., to provide user access to chamber 126 for loading and unloading of articles into and out of chamber 126 of laundry basket 120.

Conditioning system 200 may generally include a supply duct 220 that is mounted to tub 124 for circulating air within chamber 126 to facilitate a drying process. For example, according to the illustrated exemplary embodiment, supply duct 220 is fluidly coupled to tub 124 proximate opening 132 of front panel 130. More specifically, according to an example embodiment, supply duct 220 passes through a door gasket 222 that is mounted to tub 124 at opening 132 and is configured for forming a seal with door assembly 134 when door assembly 134 is in a closed position. Supply duct 220 receives heated air that has been heated and/or dehumidified by a conditioning system 200 and provides the heated air to laundry basket 120 via supply duct 220.

Specifically, moisture laden, heated air is drawn from laundry basket 120 by an air handler, such as a blower fan 224, which generates a negative air pressure within laundry basket 120. As the air passes from blower fan 224, it is circulated through chamber 126, enters a return duct 226, and then is passed into conditioning system 200. In some embodiments, the conditioning system 200 may be or include an electric heating element, e.g., a resistive heating element, or a gas-powered heating element, e.g., a gas burner. According to the illustrated exemplary embodiment, laundry appliance 100 is a heat pump dryer appliance and thus conditioning system 200 may be or include a heat pump including a sealed refrigerant circuit, as described in more detail below with reference to FIGS. 3 and 4. Heated air (with a lower moisture content than was received from laundry basket 120), exits conditioning system 200 and returns to laundry basket 120 by a supply duct 220. After the clothing articles have been dried, they are removed from the laundry basket 120 via opening 132.

As shown, laundry appliance 100 may further include one or more lint filters 230 (FIG. 3) to collect lint during drying operations. The moisture laden heated air passes through return duct 226 enclosing screen filter 230, which traps lint particles. More specifically, filter 230 may be placed into an air flow path 232 defined by laundry basket 120, conditioning system 200, return duct 226, and supply duct 220. Filter 230 may be positioned in the process air flow path 232 and may include a screen, mesh, or other material to capture lint in the air flow 232. The location of lint filters in laundry appliance 100 as shown in FIG. 3 is provided by way of example only, and other locations may be used as well. According to exemplary embodiments, lint filter 230 is readily accessible by a user of the appliance. As such, lint filter 230 should be manually cleaned by removal of the filter, pulling or wiping away accumulated lint, and then replacing the filter 230 for subsequent drying cycles.

According to exemplary embodiments, laundry appliance 100 may facilitate a steam dry process. In this regard, laundry appliance 100 may offer a steam drying cycle, during which steam is injected into chamber 126, e.g., to function similar to a traditional garment steamer to help remove wrinkles, static, etc. Accordingly, as shown for example in FIG. 3, laundry appliance 100 may include a misting nozzle 234 that is in fluid communication with a water supply 236 (e.g., such as water supply 155) in order to direct mist into chamber 126. Laundry appliance 100 may further include a water supply valve or control valve 238 for selecting discharging the flow of mist into chamber 126. It should be appreciated that control valve 238 may be positioned at any other suitable location within cabinet assembly 102.

FIG. 3 provides a schematic view of laundry appliance 100 and depicts conditioning system 200 in more detail. FIG. 4 provides a perspective view of tub 124 with conditioning system 200 positioned on top of tub 124. For this embodiment, laundry appliance 100 is a heat pump dryer appliance and thus conditioning system 200 includes a sealed system 250. Sealed system 250 includes various operational components, which can be encased or located within a machinery compartment of laundry appliance 100. Generally, the operational components are operable to execute a vapor compression cycle for heating process air passing through conditioning system 200. The operational components of sealed system 250 include an evaporator 252, a compressor 254, a condenser 256, and one or more expansion devices 258 connected in series along a refrigerant circuit or line 260. Refrigerant line 260 is charged with a working fluid, which in this example is a refrigerant. Sealed system 250 depicted in FIG. 3 is provided by way of example only. Thus, it is within the scope of the present subject matter for other configurations of the sealed system to be used as well. As will be understood by those skilled in the art, sealed system 250 may include additional components, e.g., at least one additional evaporator, compressor, expansion device, and/or condenser. As an example, sealed system 250 may include two (2) evaporators.

In performing a drying and/or tumbling cycle, one or more laundry articles LA may be placed within the chamber 126 of laundry basket 120. Hot dry air HDA is supplied to chamber 126 via supply duct 220. The hot dry air HDA enters chamber 126 of laundry basket 120 via a supply opening 264 defined by laundry basket 120, e.g., the plurality of holes defined in rear wall 206 and/or cylindrical wall 208 of laundry basket 120 as shown in FIG. 2. The hot dry air HDA provided to chamber 126 causes moisture within laundry articles LA to evaporate. Accordingly, the air within chamber 126 increases in water content and exits chamber 126 as warm moisture laden air MLA. The warm moisture laden air MLA exits chamber 126 through a return opening 266 defined by laundry basket 120 and flows into return duct 226.

After exiting chamber 126 of laundry basket 120, the warm moisture laden air MLA flows downstream to conditioning system 200. Blower fan 224 moves the warm moisture laden air MLA, as well as the air more generally, through a process air flow path 232 defined by laundry basket 120, conditioning system 200, return duct 226, and supply duct 220. Thus, generally, blower fan 224 is operable to move air through or along the process air flow path 232. The duct system includes all ducts that provide fluid communication (e.g., airflow communication) between return opening 266 and conditioning system 200 and between conditioning system 200 and supply opening 264. Although blower fan 224 is shown positioned between laundry basket 120 and conditioning system 200 along return duct 226, it will be appreciated that blower fan 224 can be positioned in other suitable positions or locations along the duct system.

As further depicted in FIG. 3, the warm moisture laden air MLA flows into or across evaporator 252 of the conditioning system 200. As the moisture-laden air MLA passes across evaporator 252, the temperature of the air is reduced through heat exchange with refrigerant that is vaporized within, for example, coils or tubing of evaporator 252. This vaporization process absorbs both the sensible and the latent heat from the moisture-laden air MLA-thereby reducing its temperature. As a result, moisture in the air is condensed and such condensate water may be drained from conditioning system 200, e.g., using a drain line 262, which is also depicted in FIG. 3.

For this embodiment, a condenser tank or a condensate collection tank 270 is in fluid communication with conditioning system 200, e.g., via drain line 262. Collection tank 270 is operable to receive condensate water from the process air flowing through conditioning system 200, and more particularly, condensate water from evaporator 252. A sensor 272 is operable to detect when water within collection tank 270 has reached a predetermined level. Sensor 272 can be any suitable type of sensor, such as a float switch as shown in FIG. 3. Sensor 272 can be communicatively coupled with controller 166, e.g., via a suitable wired or wireless communication link. A drain pump 274 (e.g., the same or similar to drain pump 146) is in fluid communication with collection tank 270. Drain pump 274 is operable to remove a volume of water from collection tank 270 and, for example, discharge the collected condensate to an external drain. In some embodiments, drain pump 274 can remove a known or predetermined volume of water from collection tank 270. Drain pump 274 can remove the condensate water from collection tank 270 and can move or drain the condensate water downstream, e.g., to a gray water collection system. Particularly, in some embodiments, controller 166 is configured to receive, from sensor 272, an input indicating that water within the collection tank has reached the predetermined level. In response to the input indicating that water within collection tank 270 has reached the predetermined level, controller 166 can cause drain pump 274 to remove the predetermined volume of water from collection tank 270.

Air passing over evaporator 252 becomes cooler than when it exited laundry basket 120 at return opening 266. As shown in FIG. 3, cool air CA (cool relative to hot dry air HDA and moisture laden air MLA) flowing downstream of evaporator 252 is subsequently caused to flow across condenser 256, e.g., across coils or tubing thereof, which condenses refrigerant therein. The refrigerant enters condenser 256 in a gaseous state at a relatively high temperature compared to the cool air CA from evaporator 252. As a result, heat energy is transferred to the cool air CA at the condenser 256, thereby elevating its temperature and providing warm dry air HDA for resupply to laundry basket 120 of laundry appliance 100. The warm dry air HDA passes over and around laundry articles LA within the chamber 126 of the laundry basket 120, such that warm moisture laden air MLA is generated, as mentioned above. Because the air is recycled through laundry basket 120 and conditioning system 200, laundry appliance 100 can have a much greater efficiency than traditional clothes dryers can where all of the warm, moisture-laden air MLA is exhausted to the environment.

With respect to sealed system 250, compressor 254 pressurizes refrigerant (i.e., increases the pressure of the refrigerant) passing therethrough and generally motivates refrigerant through the sealed refrigerant circuit or refrigerant line 260 of conditioning system 200. Compressor 254 may be communicatively coupled with controller 166 (communication lines not shown in FIG. 3). Refrigerant is supplied from the evaporator 252 to compressor 254 in a low pressure gas phase. The pressurization of the refrigerant within compressor 254 increases the temperature of the refrigerant. The compressed refrigerant is fed from compressor 254 to condenser 256 through refrigerant line 260. As the relatively cool air CA from evaporator 252 flows across condenser 256, the refrigerant is cooled and its temperature is lowered as heat is transferred to the air for supply to chamber 126 of laundry basket 120.

Upon exiting condenser 256, the refrigerant is fed through refrigerant line 260 to expansion device 258. Although only one expansion device 258 is shown, such is by way of example only. It is understood that multiple such devices may be used. In the illustrated example, expansion device 258 is an electronic expansion valve, although a thermal expansion valve or any other suitable expansion device can be used. In additional embodiments, any other suitable expansion device, such as a capillary tube, may be used as well. Expansion device 258 lowers the pressure of the refrigerant and controls the amount of refrigerant that is allowed to enter the evaporator 252. Importantly, the flow of liquid refrigerant into evaporator 252 is limited by expansion device 258 in order to keep the pressure low and allow expansion of the refrigerant back into the gas phase in evaporator 252. The evaporation of the refrigerant in evaporator 252 converts the refrigerant from its liquid-dominated phase to a gas phase while cooling and drying the moisture laden air MLA received from chamber 126 of laundry basket 120. The process is repeated as air is circulated along process air flow path 232 while the refrigerant is cycled through sealed system 250, as described above.

Although laundry appliance 100 is depicted and described herein as a heat pump dryer appliance, the inventive aspects of the present disclosure can apply to other types of closed loop airflow circuit dryer appliances. For instance, in other embodiments, laundry appliance 100 can be a condenser dryer that utilizes an air-to-air heat exchanger instead of evaporator 252 and/or an electric heater may be provided instead of condenser 256. Thus, in such embodiments, the working fluid that interacts thermally with the process air may be air. In yet other embodiments, laundry appliance 100 can be a spray tower dryer appliance that utilizes a water-to-air heat exchanger instead of utilizing a sealed refrigerant. Thus, in such embodiments, the working fluid that interacts thermally with the process air may be water. Further, in some embodiments, laundry appliance 100 can be a combination washer/dryer appliance having a closed loop airflow circuit along which process air may flow for drying operations.

Referring now generally to FIGS. 1 through 17, cabinet assembly 102 will be described in more detail according to an example embodiment of the present subject matter. In this regard, as explained briefly above, conventional cabinets of washing machine appliances include a single, large apron and a flat top cover that generally form a housing for receiving the tub, basket, and all operating components and electronics of the laundry appliance. However, combination washer/dryer appliances may include a conditioning system or heat exchange system to facilitate the washing and drying of a load of clothes in a single unit. As noted briefly above, conventional combination laundry appliances include the conditioning system within the existing space of a conventional apron. However, space constraints within such an apron may necessitate a smaller capacity conditioning system, resulting in longer dry times and poor system performance. By contrast, generating entirely new tooling and designs for a combination unit apron may be cost prohibitive. Accordingly, aspects of the present subject matter are directed to a cabinet assembly 102 that may use an existing apron along with an apron extension to provide for a combination laundry appliance with a larger conditioning system. In addition, the presently disclosed cabinet assembly provides for simplified assembly and improved rigidity.

Specifically, according to the illustrated example embodiment, cabinet assembly 102 may generally include an apron 300 that is configured for housing certain operational components for washing and/or drying, such as the tub, basket, motor, drain pump, suspension assembly, etc. In general, apron 300 may extend between a top end 302 and a bottom end 304 along the vertical direction V, between a first sidewall 306 and a second sidewall 308 along the lateral direction L, and between a front panel 310 and a rear wall 312 along the transverse direction T. According to example embodiments, apron 300 may generally include an open top end 302, which may be configured for receiving a flat top panel. According to such conventional embodiments, top end 302 of apron 300 may coincide with top end 104 of cabinet assembly 102 and laundry appliance 100 in general.

Figure 5:
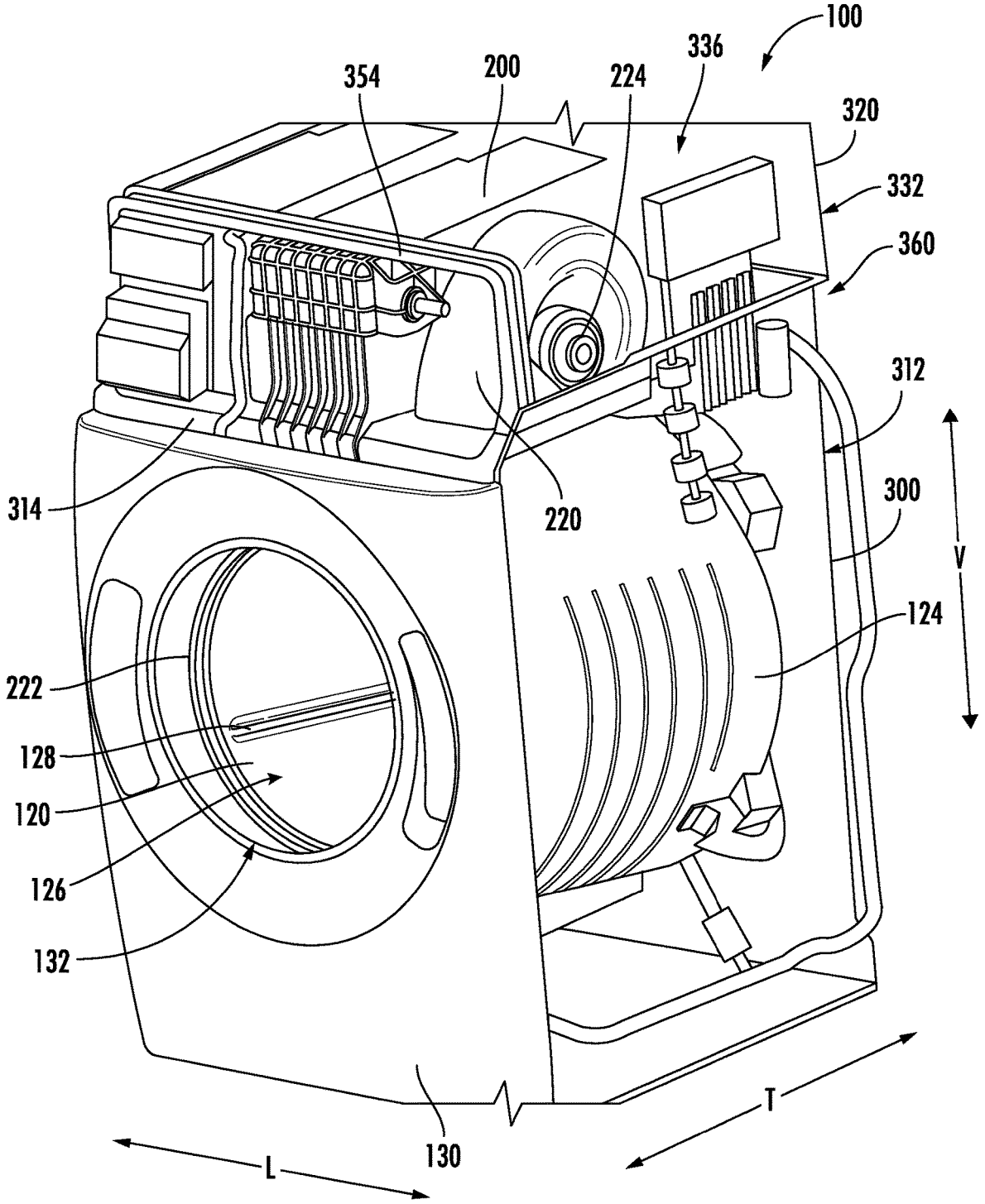
FIG. 5 provides a perspective view of the example laundry appliance of FIG. 1 with an upper panel of the laundry appliance removed to reveal certain components of the dryer appliance.
Figure 6:
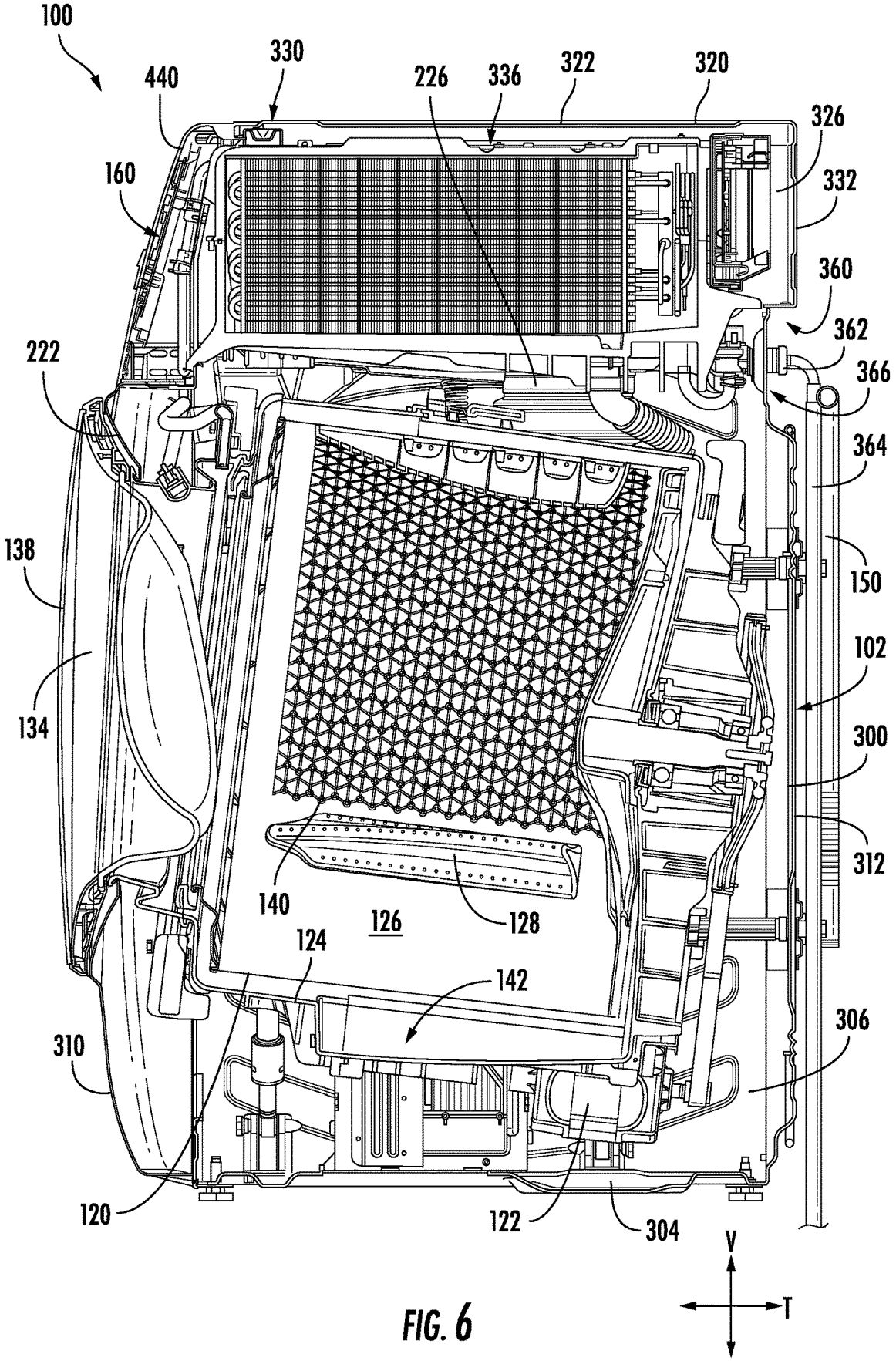
FIG. 6 provides a side cross-sectional view of the exemplary laundry appliance of FIG. 1.
Figure 7:
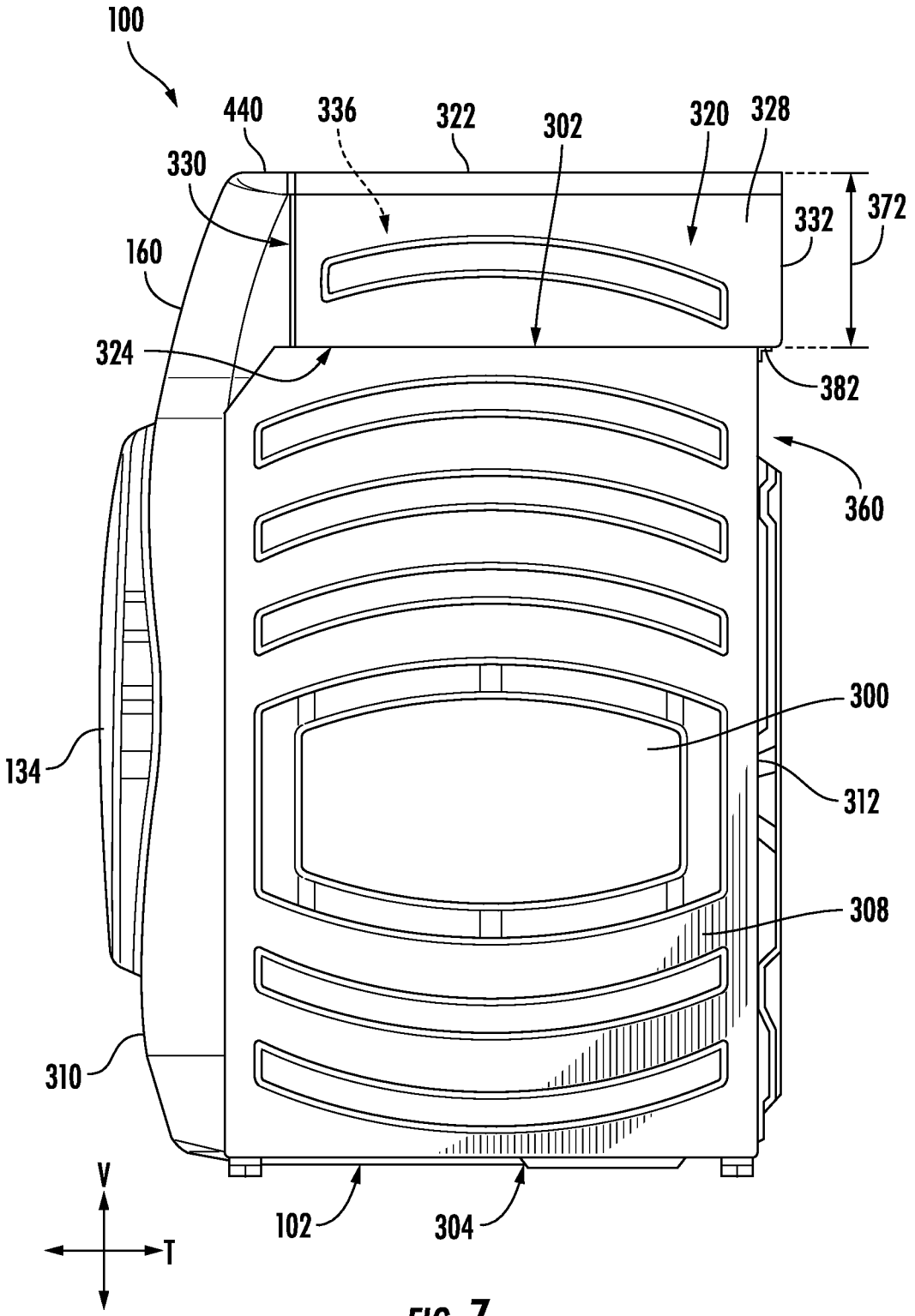
FIG. 7 provides a side view of the exemplary laundry appliance of FIG. 1 including an apron and an apron extension in accordance with exemplary embodiments of the present disclosure.
Figure 8:
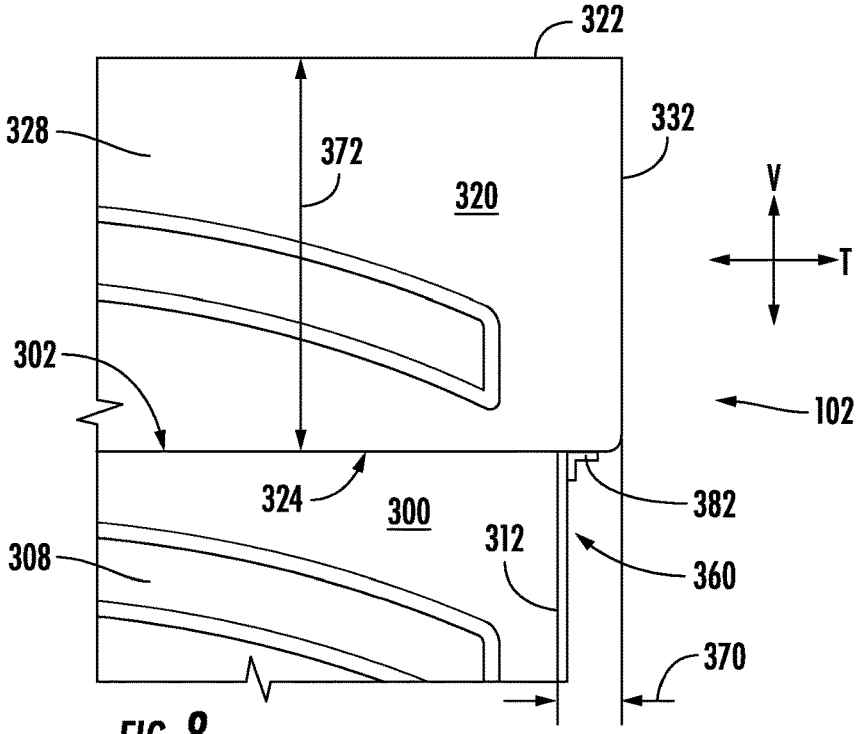
FIG. 8 provides a close-up side view of an overhang of the apron extension over a rear wall of the apron in accordance with exemplary embodiments of the present disclosure.
Figure 9:
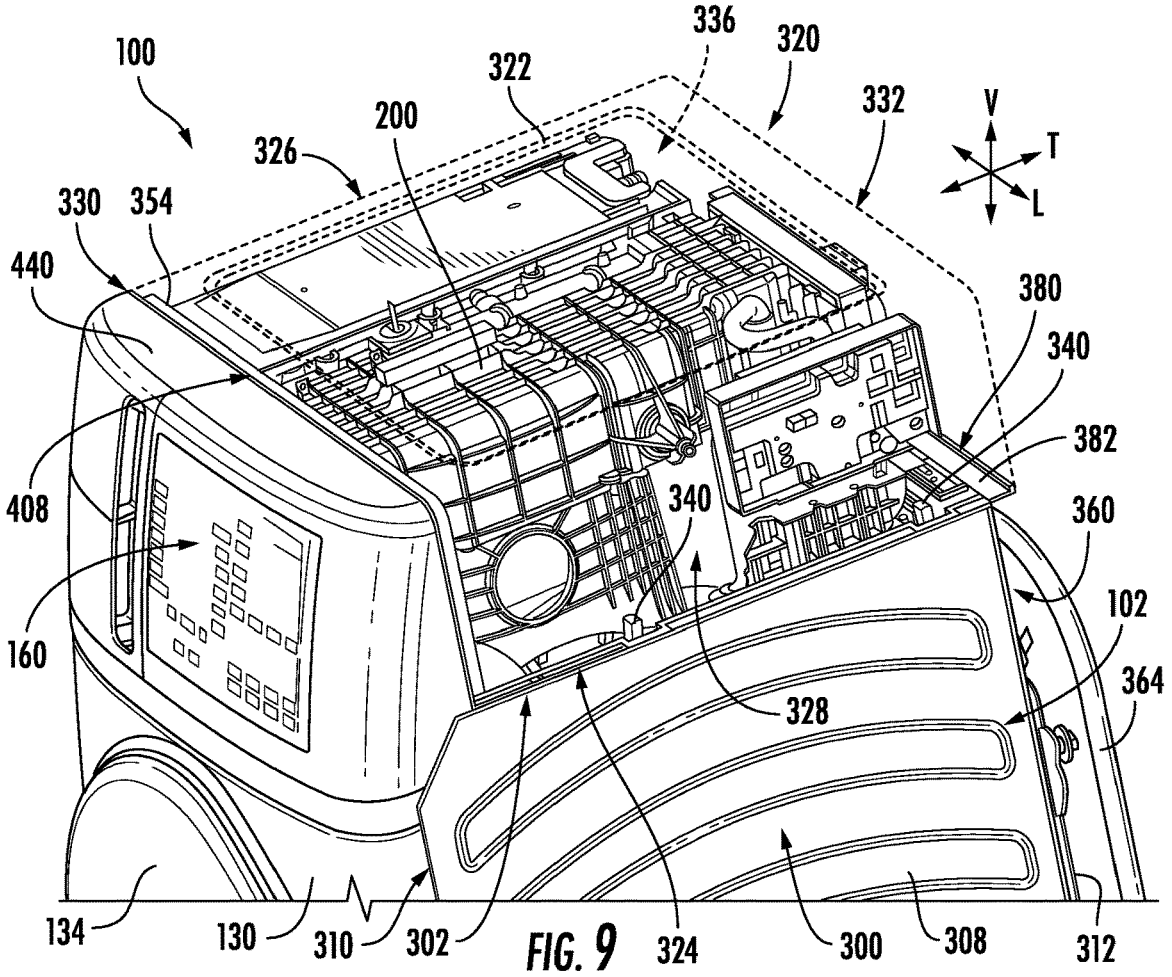
FIG. 9 provides a perspective view of the exemplary laundry appliance of FIG. 1 with the apron extension illustrated in phantom in accordance with exemplary embodiments of the present disclosure.
Figure 10:
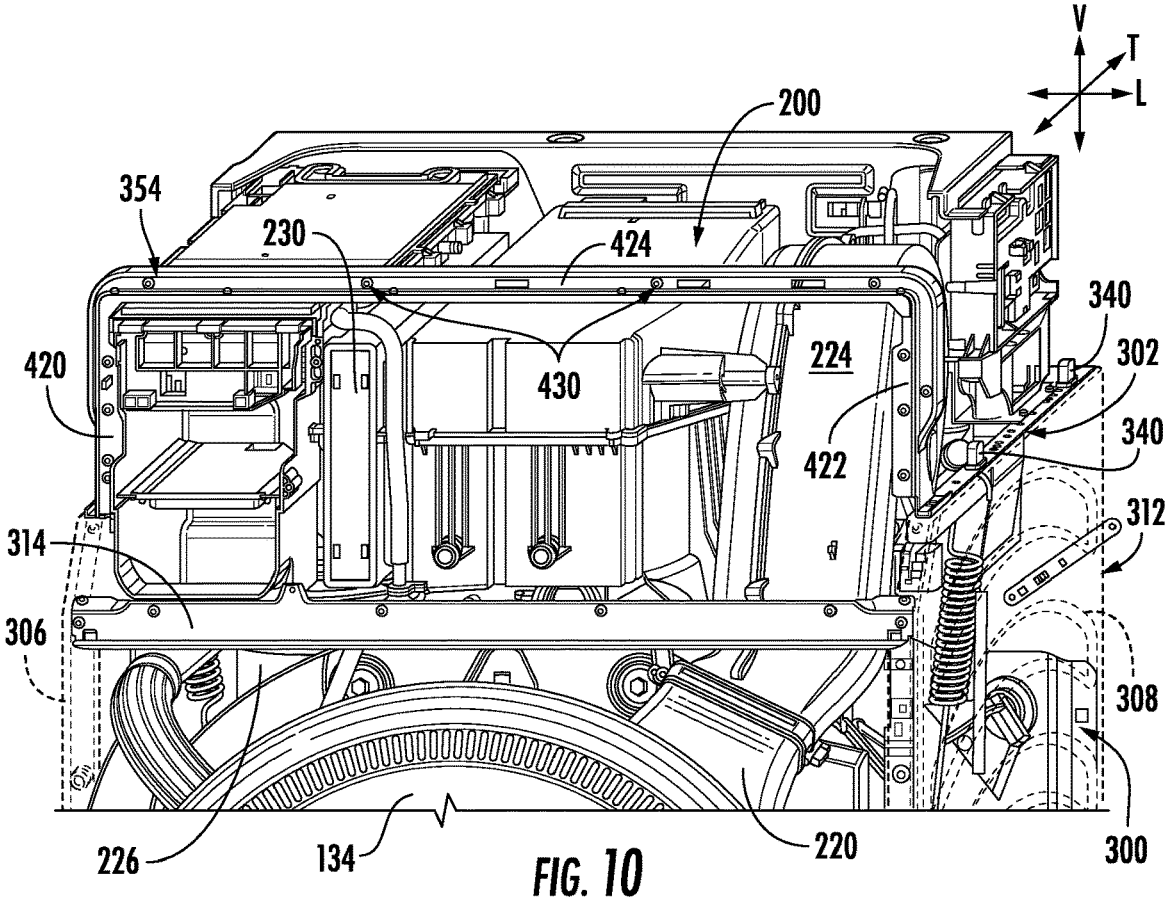
FIG. 10 provides a perspective view of the exemplary laundry appliance of FIG. 1 with the apron extension and a control panel removed in accordance with exemplary embodiments of the present disclosure.
Figure 11:
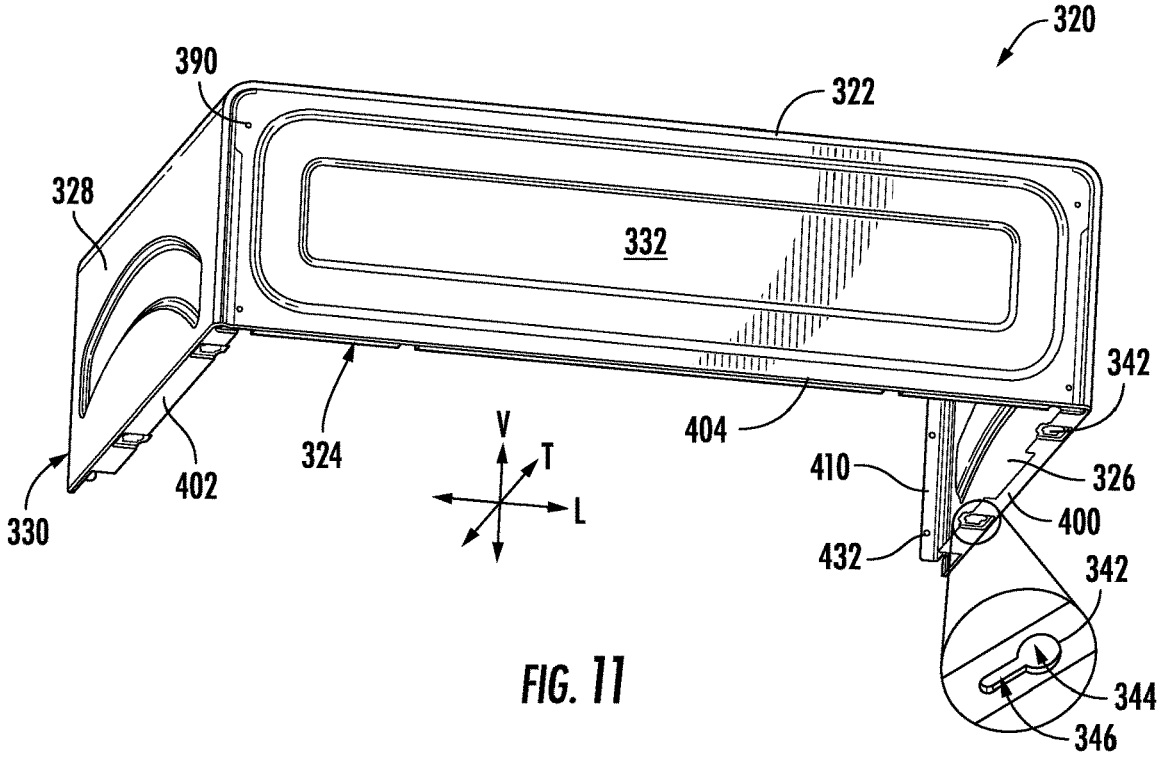
FIG. 11 provides a rear, perspective view of the apron extension in accordance with exemplary embodiments of the present disclosure.
Figure 12:
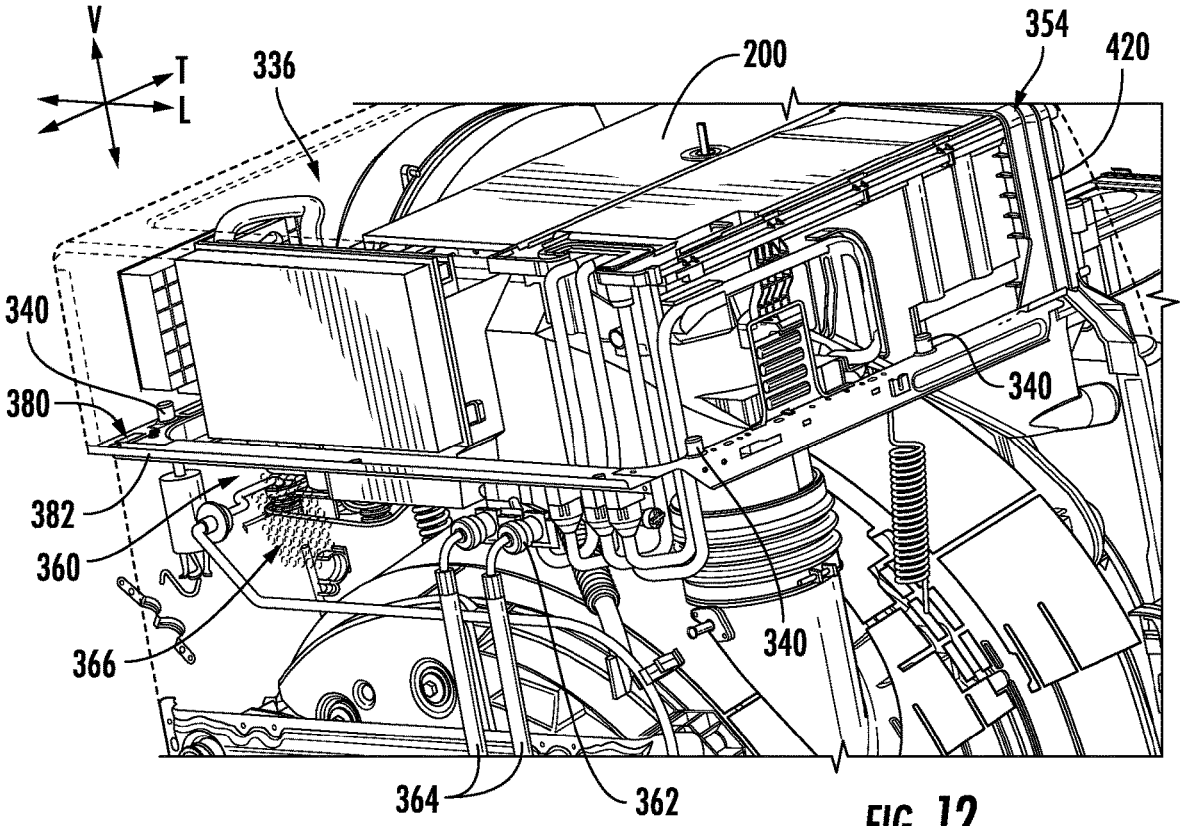
FIG. 12 provides a rear, perspective view of the exemplary laundry appliance of FIG. 1 with the apron extension and an apron illustrated in phantom in accordance with exemplary embodiments of the present disclosure.
Figure 13:
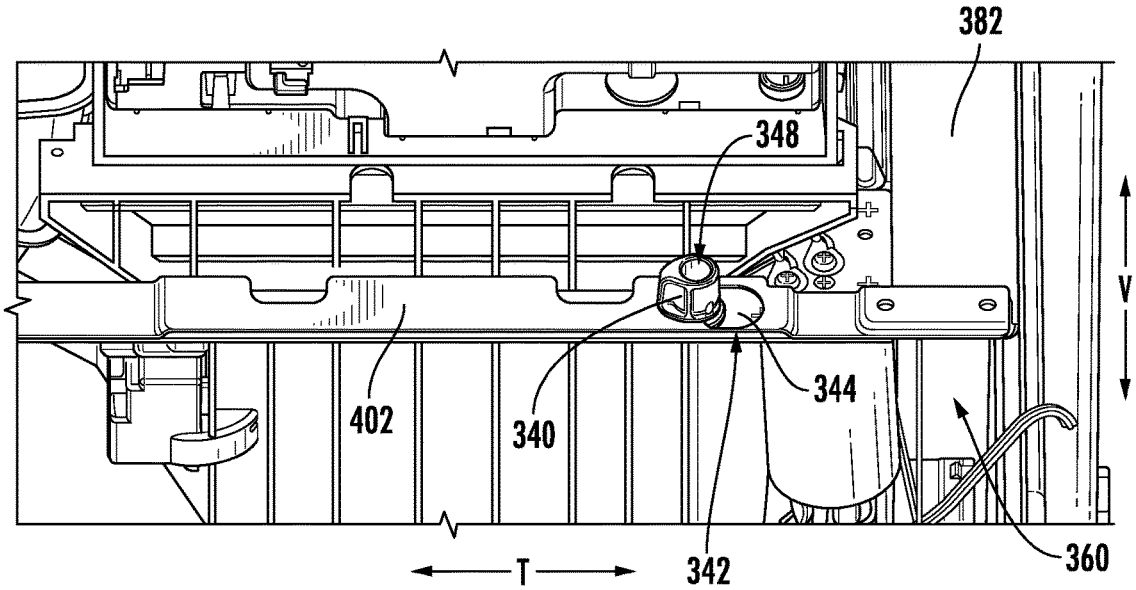
FIG. 13 provides a perspective of the apron extension mounted to mounting studs of the apron in accordance with exemplary embodiments of the present disclosure.
Figure 14:
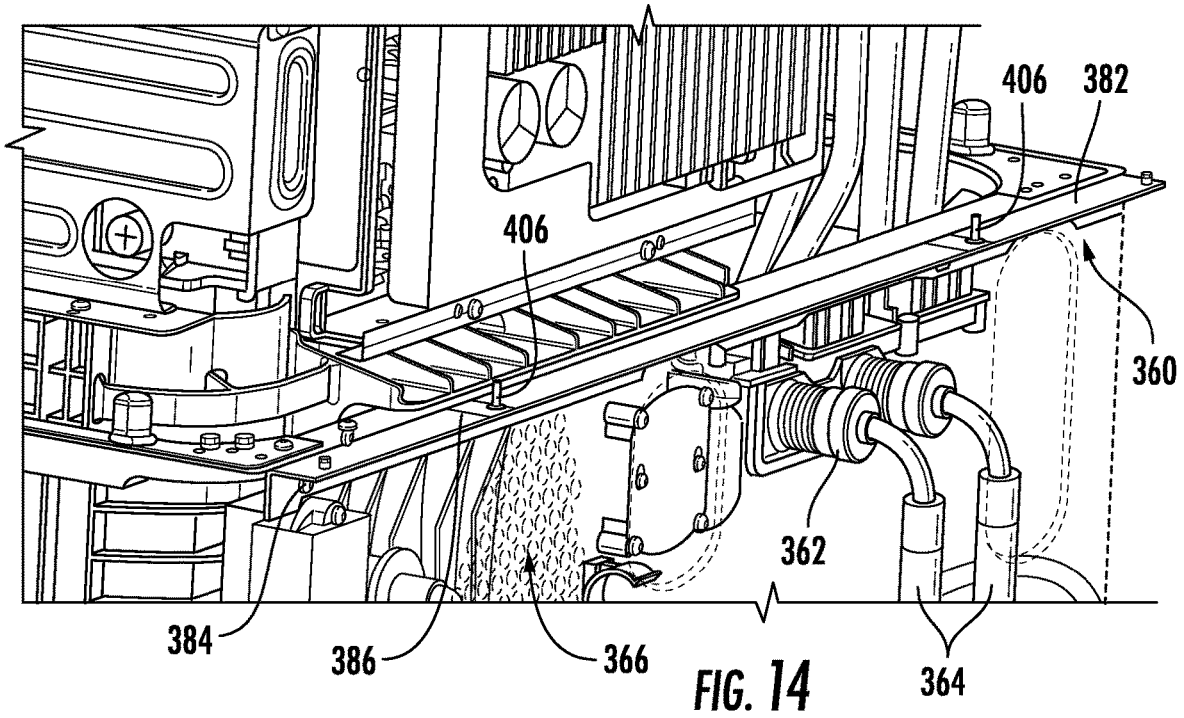
FIG. 14 provides a rear, perspective view of the exemplary laundry appliance of FIG. 1 with the apron extension removed in accordance with exemplary embodiments of the present disclosure.
Figure 15:
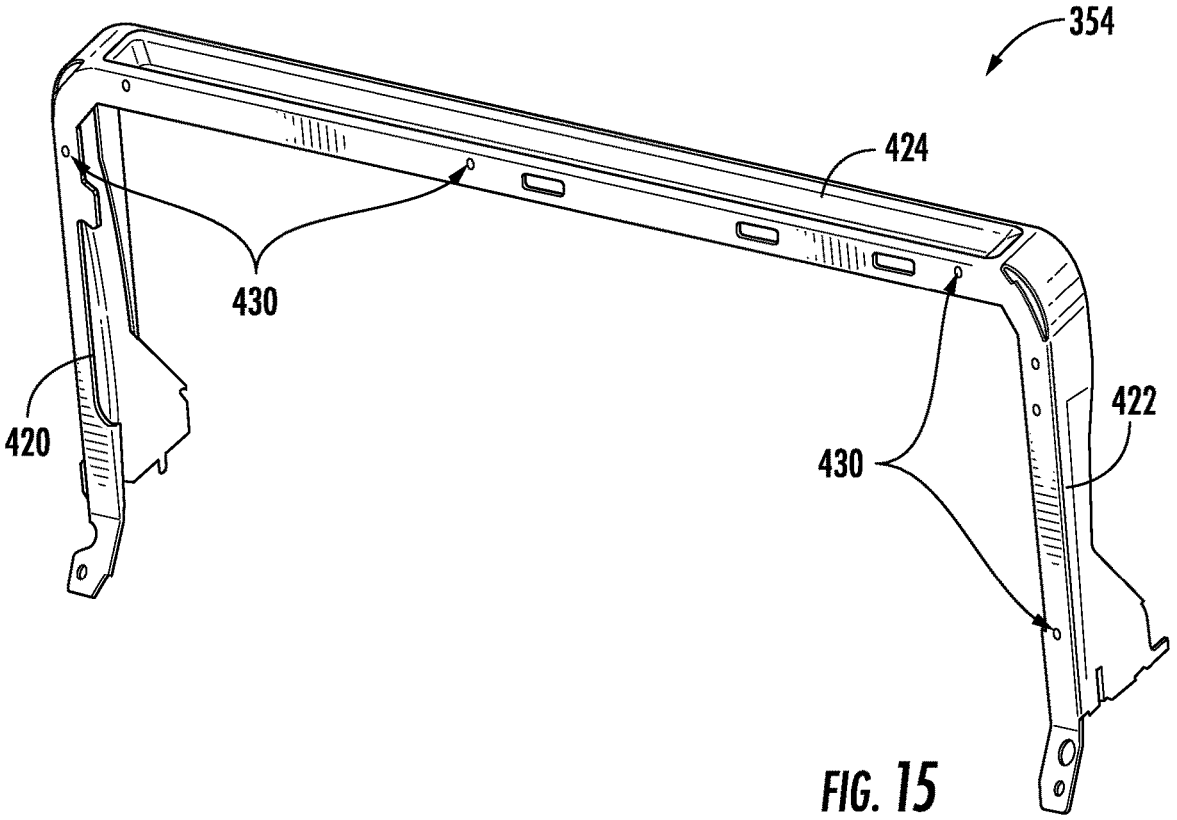
FIG. 15 provides a perspective view of a cross brace for mounting the apron extension in accordance with exemplary embodiments of the present disclosure.
Figure 16:
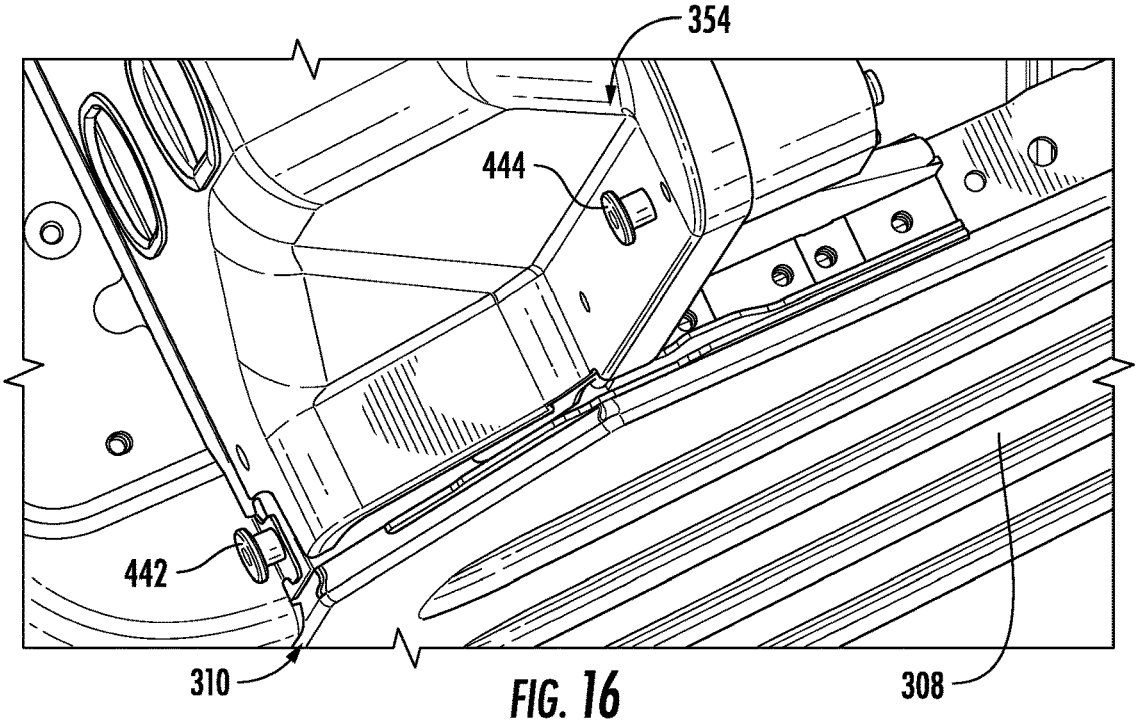
FIG. 16 provides a perspective view of the cross brace mounted to the apron in accordance with exemplary embodiments of the present disclosure.
Figure 17:
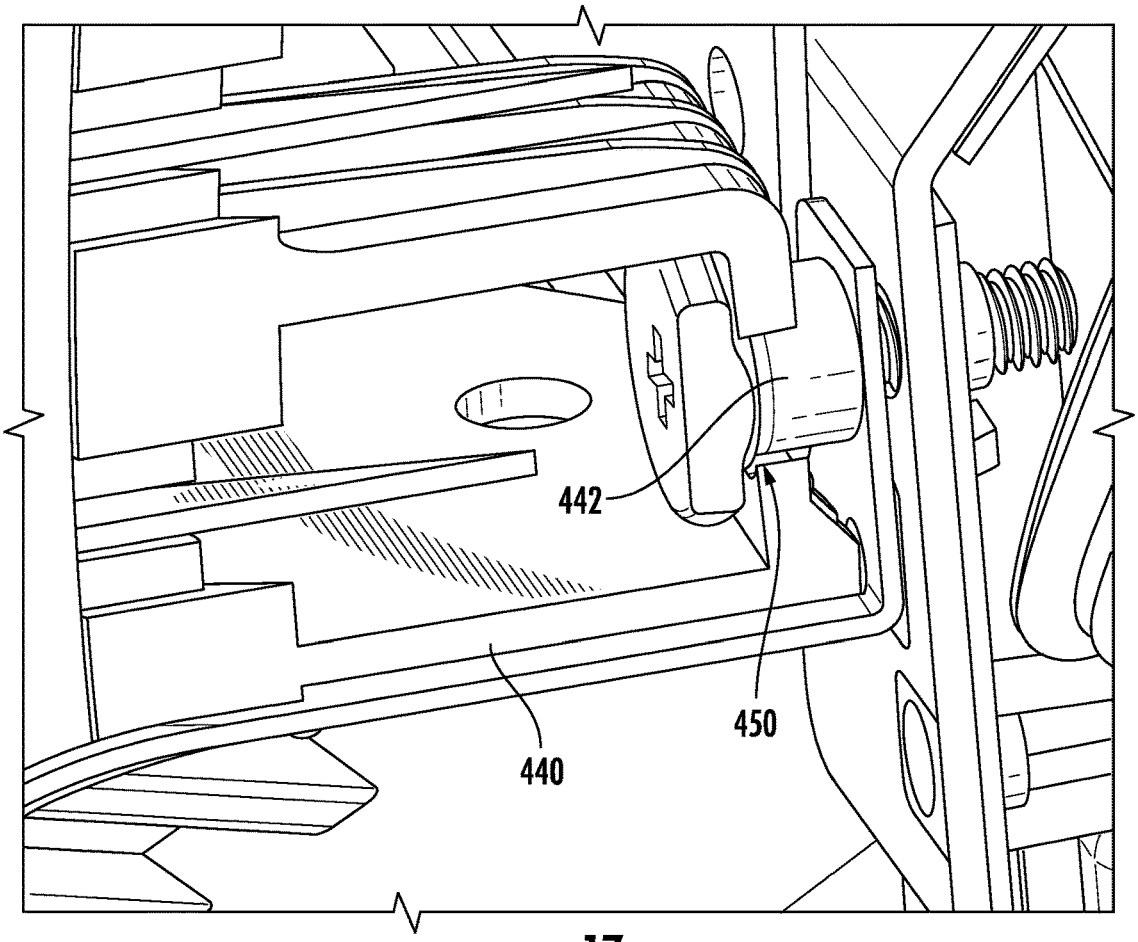
FIG. 17 provides a perspective view of the cross brace mounted to the apron and the apron extension in accordance with exemplary embodiments of the present disclosure.

As shown for example in FIGS. 5 and 10, cabinet assembly 102 may further include an apron brace 314 for generally supporting or providing rigidity to 300. In this regard, apron brace 314 may generally extend along the lateral direction L between first sidewall 306 and second sidewall 308 of apron 300 proximate top end 302 of apron 300, e.g., above front panel 130. According to example embodiments, apron brace 314 may be configured to prevent apron 300 from collapsing inward, particularly when the weight of the subwasher is suspended within apron 300.

Notably, in order to provide additional space for a drying system of laundry appliance 100 (e.g., such as conditioning system 200), cabinet assembly 102 may further include an apron extension 320 that is generally positioned on top end 302 of apron 300. In general, apron extension 320 may extend between a top wall 322 and a bottom end 324 along the vertical direction V, between a first sidewall 326 and a second sidewall 328 along the lateral direction L, and between a front end 330 and a rear wall 332 along the transverse direction T. In general, apron extension 320 may define a mechanical compartment 336 that is positioned above apron 300 along the vertical direction V. In general, mechanical compartment 336 may be configured for receiving and supporting some or all components of conditioning system 200.

According to example embodiments, apron extension 320 may generally be attached to apron 300 to form cabinet assembly 102 using a system of mounting studs in keyhole slots, as will be described in more detail below. In addition, it should be appreciated that apron extension 320 may be attached to apron 300 in any other suitable manner, e.g., such as by using mechanical fasteners, mechanical clips, or any other suitable mechanical fastening device. The mechanical connection/coupling described below is provided only as an example and is not intended to limit the scope of the present subject matter in any manner.

For example, according to the illustrated embodiment, apron 300 may generally define a plurality of mounting studs 340 that extend from top end 302 of apron 300 upward along the vertical direction V. In general, mounting studs 340 are configured for receipt within a plurality of keyhole slots 342 that are defined on apron extension 320. In this regard, keyhole slots 342 may define an entry hole 344 and a locking slot 346. In this regard, entry hole 344 may be substantially circular and may be configured for receiving mounting studs 340, whereas locking slot 346 may have a decreased diameter or opening size that is configured for restraining mounting studs 340. In this regard, mounting studs 240 may define a flared distal end 348 that is capable of passing through entry hole 344 but is prevented from passing back through locking slot 346. In this manner, to install apron extension 320, entry hole 344 may be aligned with flared distal end 348 of mounting studs 340. Apron extension 320 may be pushed toward or dropped down onto apron 300 and may be translated to pass mounting studs 340 into locking slot 346 of keyhole slots 342. More specifically, mounting studs 340 may secure apron extension 320 to apron 300 when apron extension 320 slides rearward along the transverse direction T. In this manner, flared distal end 348 may secure apron extension 320 onto apron 300.

Notably, once apron extension 320 has been attached to apron 300 in the manner described above, it may be desirable to fix the position of apron extension 320 relative to apron 300, e.g., such that mounting studs 340 are prevented from passing back out of locking slot 346. Accordingly, cabinet assembly 102 may further include a cross brace 354 that is positioned at front end 330 of apron extension 320, e.g., to prevent apron extension 320 from sliding forward along the transverse direction T. Notably, installation of apron extension 320 and cross brace 354 as described herein ensures that apron extension 320 may no longer be removable from apron 300 but is instead fixed in position by mounting studs 340 and keyhole slots 342. The construction of cross brace 354 will be described in more detail below. Other attachment methods are possible and within the scope of the present subject matter.

Notably, according to example embodiments, when apron extension 320 is positioned on apron 300 such that mounting studs 340 pass through entry holes 344, a rear wall 312 of apron 300 may align with or be in the same vertical plane as rear wall 332 of apron extension 320. Accordingly, as apron extension 320 is translated relative to apron 300 to lock apron extension 320 in place, rear wall 332 may extend beyond rear wall 312. More specifically, rear wall 332 of apron extension 320 may extend past rear wall 312 of apron 300 along the transverse direction T to define an overhang space 360 or region directly under apron extension 320. In this regard, overhang space 360 may generally be a rectangular cuboid bounded by bottom end 324 of apron extension 320 and bottom end 304 of apron 300 along the vertical direction V, by rear wall 312 of apron 300 and rear wall 332 of apron extension 320 along the transverse direction T, and by first sidewall 306 and second sidewall 308 of apron 300 along the lateral direction L.

Notably, instead of having rear wall 332 of apron extension 320 seated flush with rear wall 312 of apron 300, inventors of the present subject matter have identified several benefits to the positioning of rear wall 332 and the creation of overhang space 360. For example, positioning rear wall 332 in such a manner may provide additional room for components of laundry appliance 100, e.g., within mechanical compartment 336 of apron extension 320. Notably, the sidewalls of apron extension 320 (i.e., first sidewall 326 and second sidewall 328) may also sit flush with the sidewalls of apron 300 (i.e., first sidewall 306 and second sidewall 308) along the lateral direction L. In this manner, the lateral footprint of laundry appliance 100 may not be changed relative to apron 300 alone.

In addition, overhang space 360 may be configured for receiving external components of laundry appliance (e.g., external from cabinet assembly 102). In this regard, for example, laundry appliance 100 may include a water fitting 362 configured to receive a supply hose 364 from a water supply source (e.g., such as water supply 155). Notably, water fitting 362 may be positioned on rear wall 312 of apron 300 within overhang space 360. In this manner, water fitting 362, supply hose 364, and or drain hose 150 may be positioned at least partially within overhang space 360, e.g., such that laundry appliance 100 may be pushed directly up against a room wall (not shown). In this regard, rear wall 332 of apron extension 320 may be configured to be seated against a room wall such that overhang space 360 is maintained. According to example embodiments, rear wall 332 may be coated or covered with a dampening material to absorb vibrations. Moreover, positioning water fitting 362 and/or supply hose 364 in overhang space may prevent kinks or other damage to these components.

According to the example embodiment, laundry appliance 100 may further include an ambient air vent 366 that is defined in rear wall 312 of apron 300 for discharging a flow of air from within laundry appliance 100. Notably, laundry appliance 100 may be positioned directly against the room wall without blocking ambient air vent 366, as fluid communication between the ambient environment and within cabinet assembly 102 may always be maintained through ambient air vent 366 and overhang space 360.

As noted above, the overhang space 360 may generally be defined by the width of laundry appliance 100 and the depth of overhang of apron extension 320, and this dimension may be varied as needed depending on the application. According to example embodiments, overhang space 360 may generally define an overhang depth 370 measured along the transverse direction T. According to example embodiments, overhang depth 370 may be between about 0.25 inches and 4 inches, between about 0.5 inches and 2 inches, between about 1 inch and 1.5 inches, or about 1.1 inches. In addition, overhang space 316 may define an overhang width (not labeled) measured along the lateral direction L. In general, the overhang width may be substantially equivalent to the width of apron 300 measured along a lateral direction L.

According to example embodiments, apron extension 320 may further define an extension height 372 measured between bottom end 324 and top wall 322 of apron extension 320 along the vertical direction V. According to example embodiments, extension height 372 may be between about 4 inches and 12 inches, between about 6 inches and 10 inches, or about 8 inches. Notably, apron extension 320 may generally exhibit less rigidity as the extension height 372 of apron extension 320 increases. Accordingly, aspects of the present subject matter include structures for improving the rigidity of apron extension 320 and cabinet assembly 102 altogether, such as cross brace 354.

Notably, as explained above, rear wall 332 of apron extension 320 extends past rear wall 312 of apron 300 along the transverse direction T to define overhang space 360 under apron extension 320. Similarly, this positioning of apron extension 320 may generally define an opening 380 into mechanical compartment 336. Notably, it may be desirable to block opening 380 for various reasons. For example, it may be desirable to block opening 380 to prevent user access into mechanical compartment 336, to reduce electromagnetic interference (EMI), to isolate the interior of cabinet assembly 102 from the ambient environment, or for other safety and performance reasons. Accordingly, cabinet assembly 102 may further include a shield element 382 that is mounted to at least one of apron 300 or apron extension 320 and that is positioned at least partially over opening 380. For example, according to the illustrated embodiment, shield element 382 is mounted to rear wall 312 of apron 300 using a plurality of mechanical fasteners 384. Notably, the mechanical fasteners 384 may also provide a grounding path for the apron extension 320.

Notably, shield element 382 may be formed in any suitable manner for preventing access to mechanical compartment 336 through opening 380. For example, according to the illustrated embodiment, shield element 382 is a piece of sheet material (e.g., such as sheet metal) that is bent to form an angle. According to the illustrated embodiment, shield element 382 is L-shaped or bent to form and a 900 angle. In addition, according to an example embodiment, shield element 382 may include one or more structural ribs 386 that are generally configured for improving the rigidity or structural dexterity of shield element 382. For example, structural ribs 386 may be positioned within the 900 corner of shield element 382.

Shield element 382 may generally define any suitable size or dimension in order to prevent undesirable access through opening 380. For example, according to the illustrated embodiment, shield element 382 defines a shield depth (not labeled) measured along the transverse direction T, the shield depth being equal to overhang depth 370 of overhang space 360. In addition, shield element 382 may define a shield width measured along the lateral direction L, the shield width being equal to a width of apron 300 (not labeled). In this manner, shield element 382 may fully block opening 380.

Apron 300 and apron extension 320 may generally be formed from any suitably rigid material capable of supporting internal components of laundry appliance 100 during operation. For example, apron 300 and apron extension 320 may be formed from stamped sheet metal that is bent and joined into the desired shape. For example, referring specifically to apron extension 320, apron extension 320 may include top wall 322, first sidewall 326, second sidewall 328, and rear wall 332 which are formed from a single, unitary piece of material. For example, a single flat piece of sheet metal may be stamped and formed to define each wall. This stamped sheet metal may then be bent or folded into apron extension 320. In this regard, first sidewall 326, second sidewall 328, and rear wall 332 may be folded 900 downward relative to top wall 322. In addition, the corners where the sidewalls are folded may be intentionally radiused or curved in order to provide an improved aesthetic appearance and reduce material stresses.

According to example embodiments, at least two of top wall 322, first sidewall 326, the second sidewall 328, and rear wall 332 may be joined using a mechanical fastener. For example, according to the illustrated embodiment, one or more rivets 390 may be used to join rear wall 332 to both first sidewall 326 and second sidewall 328. In this regard, first sidewall 326 and second sidewall 328 may define attachments flanges that extend from the edges that adjoin rear wall 332 for receiving rivets 390. Notably, passing rivets 390 through rear wall 332 and into first sidewall 326 and second sidewall 328 may generally form a four-sided box in the shape of a rectangular cuboid. However, it should be appreciated that other manufacturing methods may be used, other mechanical fasteners may be used, and other geometries of apron extension 320 are possible and within the scope of the present subject matter.

According to example embodiments, apron extension 320 may define a plurality of mounting flanges that are used to secure apron extension 320 to apron 300. In this regard, first sidewall 326 may define a first mounting flange 400 and a second sidewall 328 may define a second mounting flange 402, each at bottom end 324 of apron extension 320 for securing the apron extension 320 to top end 302 of apron 300. For example, first mounting flange 400 and second mounting flange 402 may extend substantially 90° relative to first sidewall 326 and second sidewall 328, respectively, inward towards mechanical compartment 336. In addition, keyhole slots 342 may be defined through first mounting flange 400 and second mounting flange 402 for receiving mounting studs 340 as described above.

In addition, rear wall 332 of apron extension 320 may define a rear flange 404 at bottom end 324 of apron extension 320. Similar to the flanges described above, rear flange 404 may extend inward to mechanical compartment 336 at roughly 90° relative to rear wall 332. Notably, due to the construction of apron extension 320, rear wall 332 may be partially cantilevered and may be prone to flexing upon installation or during operation. Accordingly, shield element 382 may further define one or more pins 406 that are attached to or extend through shield element 382 along the vertical direction V for engaging the rear wall 332 of apron extension 320 to prevent movement of rear wall 332 in the transverse direction T. For example, rear flange 404 may define one or more apertures that are configured for receiving pins 406 to prevent flexing of rear wall 332 and improved rigidity of apron extension 320. According to the illustrated embodiment, shield element 382 includes two pins 406 spaced apart along the lateral direction L. However, it should be appreciated that according to alternative embodiments, any suitable number, size, and spacing of pins 406 are possible and within the scope of the present subject matter.

In addition, in order to secure the front end 330 of apron extension 320, apron extension 320 may define front flanges 408. Specifically, front flanges 408 may be defined on top wall 322 at front end 330 of apron extension 320. Front flange 408 may generally extend inward 900 into the mechanical compartment 336. Similarly, first sidewall 326 and second sidewall 328 may generally define front side flanges 410 at front end 330 of apron extension 320, which may also extend inward 900 into mechanical compartment 336. In general, front flange 408 and front side flanges 410 may each be configured for receiving one or more mechanical fasteners, as described herein.

According to example embodiments, cross brace 354 may generally extend along the lateral direction L between first sidewall 306 and second sidewall 308 of apron 300 and may engage front end 330 of apron extension 320 to prevent apron extension 320 from sliding forward along the transverse direction T. More specifically, as illustrated, cross brace 354 may generally include a first side arm 420 extends generally along the vertical direction V and a second side arm 422 that extends generally along the vertical direction V, the second side arm 422 being spaced apart from first side arm 420 along the lateral direction L. In addition, cross brace 354 may include a cross arm 424 that extends between the distal ends or top ends of first side arm 420 and second side arm 422. Accordingly, as illustrated, cross brace 354 may extend upward from top end 302 of apron 300 and may be generally U-shaped for supporting the sides and top of cabinet assembly 102. In addition, as illustrated, cross arm 424 may at least partially cover conditioning system 200, e.g., to protect conditioning system 200 and prevent impacts between apron extension 320 and conditioning system 200.

According to example embodiments, cross brace 354 may generally be attached to apron 300 and/or apron extension 320 using a plurality of mechanical fasteners 384. Notably, according to example embodiments, cross brace 354 may not be attached to the top end 302 of apron 300 until apron extension 320 is slid back into the installed position, e.g., to expose apertures for receiving mechanical fasteners 384. For example, according to the illustrated embodiment, cross brace 354 may define a plurality of through holes 430 and front end 330 of apron extension 320 may define a plurality of bosses 432 for receiving mechanical fasteners 384 passing through the through holes 430 of cross brace 354.

According to example embodiments, laundry appliance 100 may further include a control panel 440 (e.g., the same or similar to control panel 160) that is mounted to the top end 302 of apron 300 and/or to front end of cross brace 354. Specifically, according to example embodiments, control panel 440 may be mounted at least partially using a plurality of shoulder bolts and keyhole slots. In this regard, cabinet assembly 102 may include one or more apron shoulder bolts 442 that extend from the front panel 310 of apron 300 for engaging control panel 440. In addition, one or more brace shoulder bolts 444 may be defined on cross brace 354 for engaging control panel 440. In general, apron shoulder bolts 442 and brace shoulder bolt 444 may generally extend forward along the transverse direction T for receipt within one or more keyhole slots 450 defined on control panel 440.

It should be appreciated that control panel 440 may be mounted using any suitable number, size, and positioning of shoulder bolts. For example, control panel 440 may be mounted using four shoulder bolts, six shoulder bolts, ten shoulder bolts, or more. In addition, it should be appreciated that any other suitable mechanical fasteners may be used to secure control panel 440. For example, according to the illustrated embodiment, apron 300 may define two apron shoulder bolts 442, e.g., one on each lateral side of apron 300. In addition, cross brace 354 defined a brace shoulder bolt 444 on each of first side arm 420 and second side arm 422. According to still another embodiment, cross brace 354 may define at least one brace shoulder bolt 444 on cross arm 424.

Now that the construction and configuration of laundry appliance 100 and cabinet assembly 102 have been presented according to an exemplary embodiment of the present subject matter, an exemplary method 500 for assembling a cabinet assembly and laundry appliance is provided. Method 500 can be used to assemble cabinet assembly 102 and laundry appliance 100 or for the assembly of any other cabinet assembly. It should be appreciated that the exemplary method 500 is discussed herein only to describe exemplary aspects of the present subject matter and is not intended to be limiting.

Figure 18:
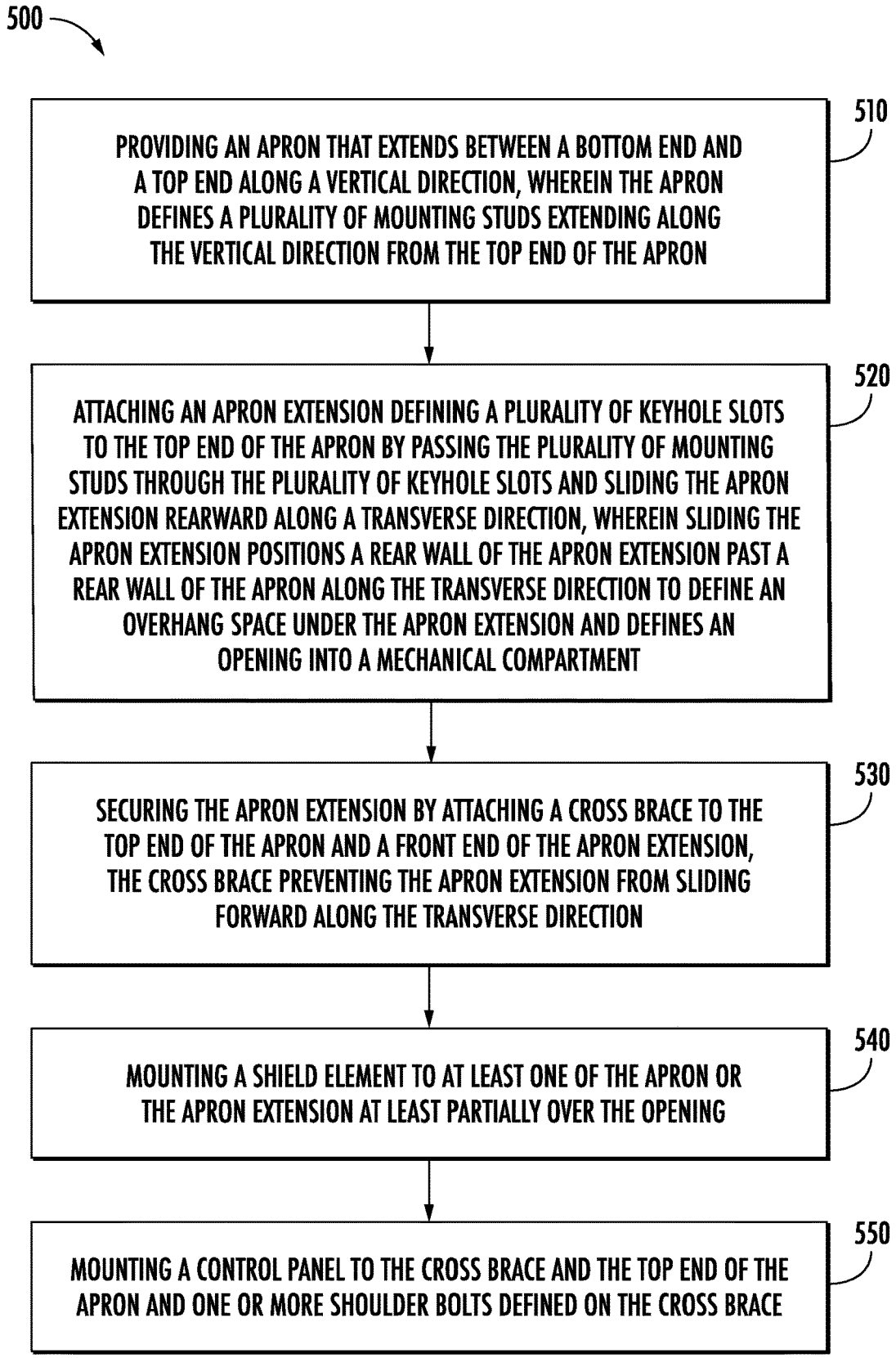
FIG. 18 provides a method of assembling a cabinet assembly of a combination laundry appliance in accordance with exemplary embodiments of the present disclosure.

As shown in FIG. 18, method 500 includes, at step 510, providing an apron that extends between a bottom end and a top end along a vertical direction, wherein the apron defines a plurality of mounting studs extending along the vertical direction from the top end of the apron.

Step 520 includes attaching an apron extension defining a plurality of keyhole slots to the top end of the apron by passing the plurality of mounting studs through the plurality of keyhole slots and sliding the apron extension rearward along a transverse direction, wherein sliding the apron extension positions a rear wall of the apron extension past a rear wall of the apron along the transverse direction to define an overhang space under the apron extension and defines an opening into a mechanical compartment.

Step 530 includes securing the apron extension by attaching a cross brace to the top end of the apron and a front end of the apron extension, the cross brace preventing the apron extension from sliding forward along the transverse direction. Step 540 includes mounting a shield element to at least one of the apron or the apron extension at least partially over the opening. Step 550 includes mounting a control panel to the cross brace and the top end of the apron and one or more shoulder bolts defined on the cross brace.

FIG. 18 depicts an exemplary control method having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using laundry appliance 100 and cabinet assembly 102 as an example, it should be appreciated that these methods may be applied to the assembly of a cabinet for any suitable laundry appliance.

As explained herein, aspects of the present subject matter are generally directed to a cabinet or apron extension that sits on top of a standard washer body to turn the washer into a combination washer-dryer, e.g., by facilitating the housing of a conditioning system above the tub. The rear portion of the extension may overhang with respect to the rear panel of the primary cabinet/apron. Further, a shield flange may be mounted on the rear wall of the apron extension to prevent access to the drying system and electronic components accommodated inside the extension. While the combination washer-dryer is placed close to the wall of a building, the rear wall of the extension may sit flush against the building wall. Thus, the overhang may ensure that the ambient air vents are prevented from getting blocked and the hoses provided on the back of the washer-dryer body are prevented from getting squeezed. As the overhanging part of the apron extension utilizes the space that is kept between the washer-dryer and building wall, it offers extra volume for accommodating dryer system in the apron extension.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance defining a vertical direction, a lateral direction, and a transverse direction, the laundry appliance comprising:

an apron extending between a bottom end and a top end along the vertical direction, wherein the apron defines a plurality of mounting studs extending from the top end of the apron;

a tub positioned within the apron;

a wash basket rotatably mounted within the tub, the wash basket defining a chamber for receipt of articles for washing and drying;

an apron extension positioned on the top end of the apron and defining a mechanical compartment, wherein a rear wall of the apron extension extends past a rear wall of the apron along the transverse direction to define an overhang space under the apron extension, wherein the apron extension defines a plurality of keyhole slots configured for engaging the plurality of mounting studs to attach the apron extension to the apron, wherein the plurality of keyhole slots extend along the transverse direction such that the plurality of mounting studs secure the apron extension to the apron when the apron extension slides rearward along the transverse direction; and a conditioning system positioned within the mechanical compartment and configured to heat and remove moisture from air flowing therethrough, the conditioning system comprising a compressor, an evaporator, and a condenser.

2. The laundry appliance of claim 1, further comprising:

a water fitting configured to receive a supply hose from a water supply source, the water fitting being positioned on the rear wall of the apron within the overhang space.

3. The laundry appliance of claim 1, further comprising:

an ambient air vent defined on the rear wall of the apron for discharging a flow of air into the overhang space.

4. The laundry appliance of claim 1, wherein sidewalls of the apron sit flush with sidewalls of the apron extension along the lateral direction.

5. The laundry appliance of claim 1, wherein a rear wall of the apron extension is configured to be seated against a room wall such that the overhang space is maintained.

6. The laundry appliance of claim 1, wherein the overhang space defines an overhang depth of between about 0.5 and 2 inches.

7. The laundry appliance of claim 6, wherein the overhang depth is about 1.1 inches.

8. The laundry appliance of claim 1, wherein the apron extension defines an extension height of between about 6 inches and 10 inches.

9. The laundry appliance of claim 8, wherein the extension height is about 8 inches.

10. The laundry appliance of claim 1, wherein the overhang space is a rectangular cuboid bounded by a bottom end of the apron extension and a bottom end of the apron along the vertical direction.

11. The laundry appliance of claim 1, further comprising:

a cross brace extending along the lateral direction between a first side and a second side of the apron and engaging a front end of the apron extension to prevent the apron extension from sliding forward along the transverse direction.

12. A laundry appliance defining a vertical direction, a lateral direction, and a transverse direction, the laundry appliance comprising:

an apron extending between a bottom end and a top end along the vertical direction, the apron defining a plurality of mounting studs extending from the top end of the apron, wherein the apron defines a plurality of mounting studs extending from the top end of the apron; and an apron extension positioned on the top end of the apron and defining a plurality of keyhole slots configured for engaging the plurality of mounting studs to attach the apron extension to the apron, wherein a rear wall of the apron extension extends past a rear wall of the apron along the transverse direction to define an overhang space under the apron extension, wherein the plurality of keyhole slots extend along the transverse direction such that the plurality of mounting studs secure the apron extension to the apron when the apron extension slides rearward along the transverse direction.

13. The laundry appliance of claim 12, further comprising:

a cross brace extending along the lateral direction between a first side and a second side of the apron and engaging a front end of the apron extension to prevent the apron extension from sliding forward along the transverse direction.

14. The laundry appliance of claim 12, further comprising:

a water fitting configured to receive a supply hose from a water supply source, the water fitting being positioned on the rear wall of the apron within the overhang space.

15. The laundry appliance of claim 12, wherein a rear wall of the apron extension is configured to be seated against a room wall such that the overhang space is maintained.

16. The laundry appliance of claim 12, wherein the overhang space defines an overhang depth of between about 0.5 and 2 inches.

17. The laundry appliance of claim 12, wherein the apron extension defines an extension height of between about 6 inches and 10 inches.

* * * * *